US010541470B2

(12) United States Patent
Jeon et al.

(10) Patent No.: US 10,541,470 B2
(45) Date of Patent: Jan. 21, 2020

(54) APPARATUS AND METHOD FOR CONTROLLING SPEED OF SATELLITE ANTENNA

(71) Applicant: Korea Aerospace Research Institute, Daejeon (KR)

(72) Inventors: Moon Jin Jeon, Daejeon (KR); Seong Bin Lim, Daejeon (KR)

(73) Assignee: KOREA AEROSPACE RESEARCH INSTITUTE, Daejeon (KR)

( * ) Notice: Subject to any disclaimer, the term of this patent is extended or adjusted under 35 U.S.C. 154(b) by 381 days.

(21) Appl. No.: 15/381,483

(22) Filed: Dec. 16, 2016

(65) Prior Publication Data

US 2017/0310001 A1 Oct. 26, 2017

(30) Foreign Application Priority Data

Apr. 21, 2016 (KR) ..... 10-2016-0048846

(51) Int. Cl.
*H01Q 3/08* (2006.01)
*H01Q 1/28* (2006.01)
*H01Q 3/02* (2006.01)

(52) U.S. Cl.
CPC ..... *H01Q 3/08* (2013.01); *H01Q 1/288* (2013.01); *H01Q 3/02* (2013.01)

(58) Field of Classification Search
CPC ..... H01Q 1/28; H01Q 1/288; H01Q 3/08; H01Q 3/02; H01Q 3/10; H04B 7/1851; H04B 7/18513; H04B 7/18515
See application file for complete search history.

(56) References Cited

U.S. PATENT DOCUMENTS 4,463,297 A * 7/1984 Bennett ..... H01Q 3/08 318/561
4,776,540 A * 10/1988 Westerlund ..... B64G 1/24 244/164
5,062,592 A * 11/1991 Kishimoto ..... B64G 1/24 244/164
5,132,910 A * 7/1992 Scheit ..... B64G 1/36 244/164
5,738,309 A * 4/1998 Fowell ..... B64G 1/24 244/164
5,745,069 A * 4/1998 Gail ..... G01S 7/2813 342/162
6,184,825 B1 * 2/2001 Wehner ..... H01Q 3/02 342/358

(Continued)

FOREIGN PATENT DOCUMENTS

EP 0403684 A2 * 12/1990 ..... H01Q 3/02
JP H07-283642 A 10/1995
KR 10-1550446 B1 9/2015

*Primary Examiner* — Gregory C. Issing

(57) ABSTRACT

Provided is an apparatus for controlling a driving speed of an antenna of a mobile satellite travelling in an orbit. The apparatus may include a calculator configured to calculate an azimuth position range and an elevation position range for an effective beam width of the antenna based on an antenna orientation at which the antenna of the mobile satellite is oriented correctly to a ground station from a point in the orbit, and a controller configured to control a speed of the antenna based on a first azimuth in the azimuth position range and a first elevation in the elevation position range.

13 Claims, 19 Drawing Sheets

(56) References Cited

U.S. PATENT DOCUMENTS

| | | | | |
|---|---|---|---|---|
| 6,195,037 | B1 * | 2/2001 | Gross | H04B 7/2041<br>342/354 |
| 8,149,176 | B2 * | 4/2012 | Hellberg | H01Q 1/288<br>343/763 |
| 9,246,207 | B2 * | 1/2016 | Smith | H01Q 3/08 |
| 2010/0201566 | A1 * | 8/2010 | Wyler | H04B 7/18513<br>342/354 |
| 2010/0265149 | A1 * | 10/2010 | Omori | G01S 3/42<br>343/766 |

* cited by examiner

BACKGROUND ART

APPARATUS AND METHOD FOR CONTROLLING SPEED OF SATELLITE ANTENNA

CROSS-REFERENCE TO RELATED APPLICATION

This application claims the priority benefit of Korean Patent Application No. 10-2016-0048846 filed on Apr. 21, 2016, in the Korean Intellectual Property Office, the disclosure of which is incorporated herein by reference for all purposes.

BACKGROUND

1. Field

One or more example embodiments relate to an apparatus and method for controlling a speed of a satellite antenna, and more particularly, to a method of optimizing a driving speed of an antenna provided in a low earth orbit satellite.

2. Description of Related Art

Numerous satellites may use an antenna having a specific effective beam width and directivity to transmit image data to a terrestrial destination. Due to a limited beam width of an antenna, the antenna may need to be oriented to a ground station to transmit image data. In a case of a multi-purpose satellite, a biaxial gimbal-type structure may be used to orient an antenna to a specific direction An orientation of the antenna may be represented by angles in two axes, for example, an angle in an azimuth direction of rotating on a Z axis of the satellite, and an angle in an elevation direction of rotating on an axis vertical to the angle in the azimuth direction (i.e., an axis in a direction on an X-Y plane of the satellite).

FIG. 1 is a diagram illustrating an orientation of an antenna on three-dimensional (3D) coordinates, in which an azimuth α 110 and an elevation β 120 are indicated with respect to an antenna orientation p 100. When an antenna of a satellite is correctly oriented to a ground station from a certain point in an orbit of the satellite, an orientation of the antenna in a satellite body coordinate system may be calculated using orbit information and attitude information of the satellite and location information of the ground station. Referring to FIG. 1, the azimuth α 110 and the elevation β 120 may be calculated using the 3D coordinates (x, y, z) of the antenna orientation p 100 as represented by Equation 1 below.

$$\alpha = \tan^{-1}\left(\frac{y}{x}\right) \qquad \text{[Equation 1]}$$
$$\beta = \sin^{-1}(z)$$

Thus, an azimuth and an elevation at which an antenna of a satellite needs to have in an entire section for communication may be calculated in advance, and be uploaded to the satellite to be used.

SUMMARY

According to an aspect, there is provided an apparatus for controlling a driving speed of an antenna of a mobile satellite travelling in an orbit, the apparatus including a calculator configured to calculate an azimuth position range and an elevation position range for an effective beam width of the antenna, based on a first antenna orientation at which the antenna is oriented correctly to a ground station from a first point in the orbit, and a controller configured to control a driving speed of the antenna based on a path profile including a first azimuth in the azimuth position range and a first elevation in the elevation position range.

The calculator may include an azimuth position range calculator configured to calculate the azimuth position range by calculating a first circle corresponding to the effective beam width based on a vector of the first antenna orientation on a first sphere of which a center is center coordinates of the vector of the first antenna orientation, and using a circular arc obtained by projecting a circular arc on the first sphere passing a center of the first circle onto a two-dimensional (2D) plane and using an ellipse obtained by projecting the first circle onto the 2D plane, and an elevation position range calculator configured to calculate the elevation position range by projecting the first circle and a circle for the first azimuth in the azimuth position range passing the first circle onto the 2D plane, and using a straight line indicating a change in elevation in association with the first azimuth and using the circles obtained through the projections.

In addition, the calculator may include a path profile generator configured to generate, using an upper boundary, or a maximum (max) boundary, including a maximum value in the azimuth position range or the elevation position range, a lower boundary, or a minimum (min) boundary, including a minimum value in the azimuth position range or the elevation position range, a start point of the orbit, and an end point of the orbit, a shortest path having a shortest total distance among a plurality of paths extending from the start point to the end point and having a value greater than the lower boundary and less than the upper boundary. The path profile generator may calculate the shortest path using a shortest path algorithm.

The path profile generator may generate the shortest path by adding the start point and the end point as a new fixed point to a shortest route fixed point array including at least one fixed point indicating a value of a position in the orbit based on a time and, in response to presence of an intersection point between a straight line passing all two successive fixed points included in the shortest route fixed point array and the upper boundary or the lower boundary, updating the shortest route fixed point array by adding, to the shortest route fixed point array as a new fixed point, a point on the upper boundary or the lower boundary that is separated farthest from the straight line in a time section classified by the intersection point.

The calculator may include a first velocity optimizer configured to calculate the upper boundary including a maximum value in the azimuth position range or the elevation position range, and the lower boundary including a minimum value in the azimuth position range or the elevation position range, extract a first section in which a fixed angular velocity needs to be maintained in the upper boundary or the lower boundary, and change the upper boundary or the lower boundary corresponding to the extracted first section based on a velocity limit.

The calculator may include a second velocity optimizer configured to calculate the upper boundary including a maximum value in the azimuth position range or the elevation position range, and the lower boundary including a minimum value in the azimuth position range or the elevation position range, extract, from the upper boundary, a section in which an angular acceleration of the antenna is greater than a preset first threshold value, or extract, from the lower boundary, a section in which the angular acceleration of the antenna is less than a second threshold value, and change the upper boundary or the lower boundary using the first threshold value or the second threshold value for the respective extracted sections.

The mobile satellite may include a biaxial gimbal-type antenna.

According to another aspect, there is provided a mobile satellite including a calculator configured to calculate a first antenna orientation at which an antenna of the mobile satellite is oriented correctly to a ground station from a first point in an orbit of the mobile satellite, and determine an azimuth position value and an elevation position value of the antenna based on an azimuth position range and an elevation position range for an effective beam width of the antenna based on the first antenna orientation, and a driver configured to travel to the first point at the determined azimuth position value and the determined elevation position value.

According to still another aspect, there is provided a computer program embodied on a non-transitory computer readable medium, the computer program being configured to cause a computing device to control a speed of an antenna of a mobile satellite, the program including an instruction set configured to calculate an azimuth and an elevation with respect to a first antenna orientation at which the antenna of the mobile satellite travelling in an orbit is oriented correctly to a ground station and calculate an azimuth position range for an effective beam width of the antenna with respect to the elevation, an instruction set configured to select an azimuth at which the antenna has a minimum speed from the azimuth position range, an instruction set configured to calculate an elevation position range for the effective beam width of the antenna with respect to the selected azimuth, an instruction set configured to select an elevation at which the antenna has a minimum speed from the elevation position range, and an instruction set configured to control a speed of the antenna at the first position based on the selected azimuth and the selected elevation.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the present disclosure will become apparent and more readily appreciated from the following description of example embodiments, taken in conjunction with the accompanying drawings of which.

DETAILED DESCRIPTION

Figure 1:
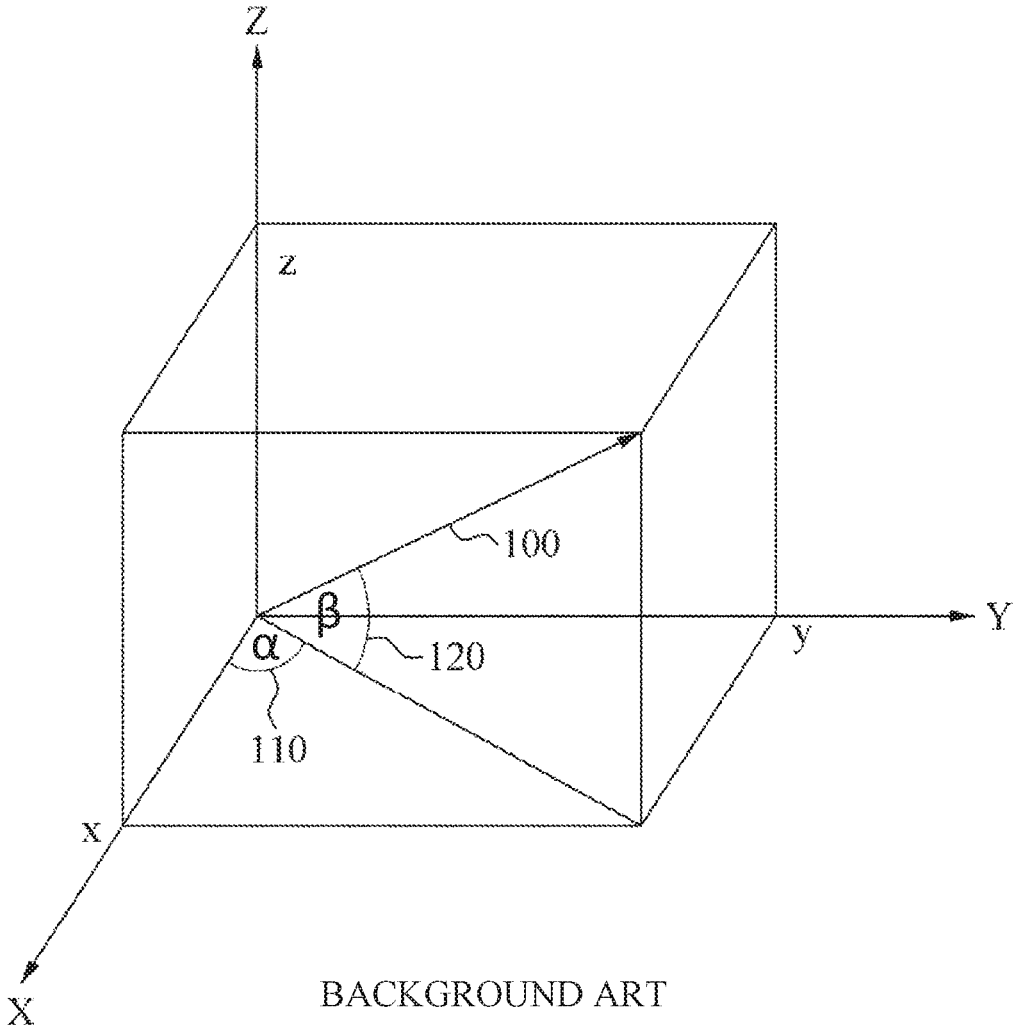
FIG. 1 is a diagram illustrating an orientation of an antenna of a satellite on three-dimensional (3D) coordinates according to an example embodiment.

Reference will now be made in detail to embodiments of the present disclosure, examples of which are illustrated in the accompanying drawings, wherein like reference numerals refer to the like elements throughout. Here, the examples are not construed as being intended to limit the present disclosure and should be understood to include all changes, equivalents, and replacements within the idea and the technical scope of the present disclosure.

Unless otherwise defined, all terms including technical and scientific terms used herein have the same meaning as currently and widely used and also commonly understood by one of ordinary skill in the art to which these example embodiments belong. It will be further understood that the terms used herein may vary depending on an intention of one of ordinary skill in the art, a convention, or the development of technology or the advent of new technology.

In addition, some terms used herein are selected by an applicant(s) to assist the reader in gaining an understanding about the example embodiments and/or provide convenience for description. In such a case, detailed meanings of the terms will be described in Detailed Description. Thus, the terms used herein should be interpreted as having a meaning that is consistent with their meaning in the context of the present disclosure and will not be interpreted as having a meaning simply indicated by the terms per se.

When a mobile satellite travels in a preset orbit, an elevation of an antenna of the mobile satellite that is correctly oriented to a ground station may pass around 90 degrees (°). In a case that an antenna driving device (or a driver as used hereinafter) of the mobile satellite is provided in a biaxial (or two-axis) gimbal structure, an elevation of an antenna of the mobile satellite may be structurally 90°, and thus an azimuthal velocity may rapidly increase and a path that is at almost 90° may be formed. Such a rapid movement may exceed a dynamic limit of the antenna, and thus the antenna may not move along the path based on a path profile associated with the path. In addition, a microvibraion generated in the antenna when the antenna rotates at a certain angular velocity may result in a jitter by resonance with the satellite. In a case of terrestrial image capturing in which both image capturing and image transmission are performed during a movement, such a jitter may significantly degrade an image quality. For example, in a case of a domestic strip imaging mode of a low earth orbit satellite, degradation in an image quality may occur frequently by a jitter. To prevent such a degradation, a method of orienting an antenna of a mobile satellite towards a virtual ground station that is separated far from a range satisfying an effective beam width of the antenna, instead of orienting the antenna correctly to an actual ground station, may be used. Here, an experimentally determined value may be used to determine how far the virtual ground station is separated from the actual ground station in which direction. In addition, another method of orienting an antenna of a mobile satellite along a terrestrial semicircular orbit may also be used. The methods described in the foregoing may achieve an empirical effect in decreasing a speed of the antenna, but may not minimize the speed theoretically. According to example embodiments described herein, a driving speed of an antenna of a satellite may be kinematically minimized, and thus an issue of a jitter may be prevented using a shortest path profile, and image capturing and image transmission may be stably performed.

Figure 2:
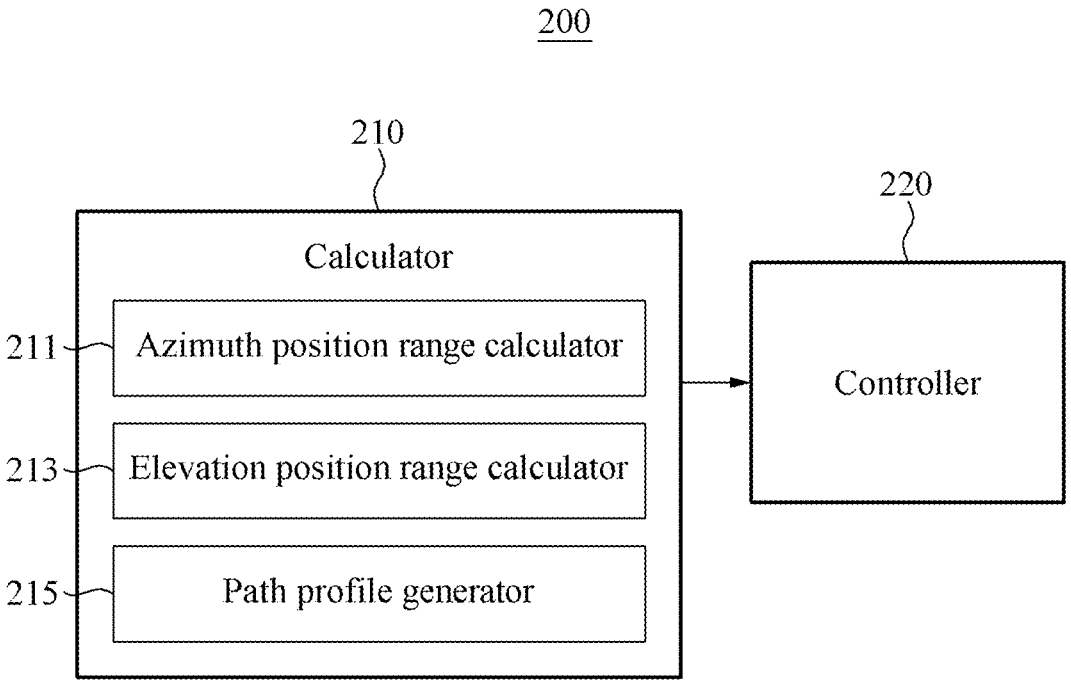
FIG. 2 is a diagram illustrating an apparatus for controlling a driving speed of an antenna of a mobile satellite according to an example embodiment.

FIG. 2 is a diagram illustrating an apparatus 200 for controlling a driving speed of an antenna of a mobile satellite according to an example embodiment. Referring to FIG. 2, the apparatus 200 includes a calculator 210 configured to generate a path profile associated with an azimuth and an elevation that minimize a speed of the antenna within an effective beam width of the antenna of the mobile satellite, and a controller 220 configured to control a driving speed of the antenna based on the path profile, for example, an azimuth profile and an elevation profile for a shortest path. An antenna driving device (or an antenna driver to be used hereinafter) of the mobile satellite may be of a biaxial (or two-axis) gimbal type to orient the antenna to a certain direction. In the biaxial gimbal type, angles in two axes may be an angle in an azimuthal direction of rotation on a Z axis and an angle in an elevation direction of rotation on an axis vertical to the azimuthal direction, for example, an axis in a direction on an XY plane.

The calculator 210 may calculate an azimuth position range and an elevation position range that satisfy the effective beam width of the antenna based on an antenna orientation when the antenna of the mobile satellite is oriented correctly to a ground station from a certain point in an orbit of the mobile satellite. In detail, as illustrated in FIG. 2, the calculator 210 includes an azimuth position range calculator 211 configured to fix (or set) an accurate elevation and calculate the azimuth position range, and an elevation position range calculator 213 configured to calculate the elevation position range with respect to an optimized azimuth in the azimuth position range. A detailed description of the azimuth position range calculator 211 and the elevation position range calculator 213 will be provided with reference to FIGS. 3 through 8.

Figure 3:
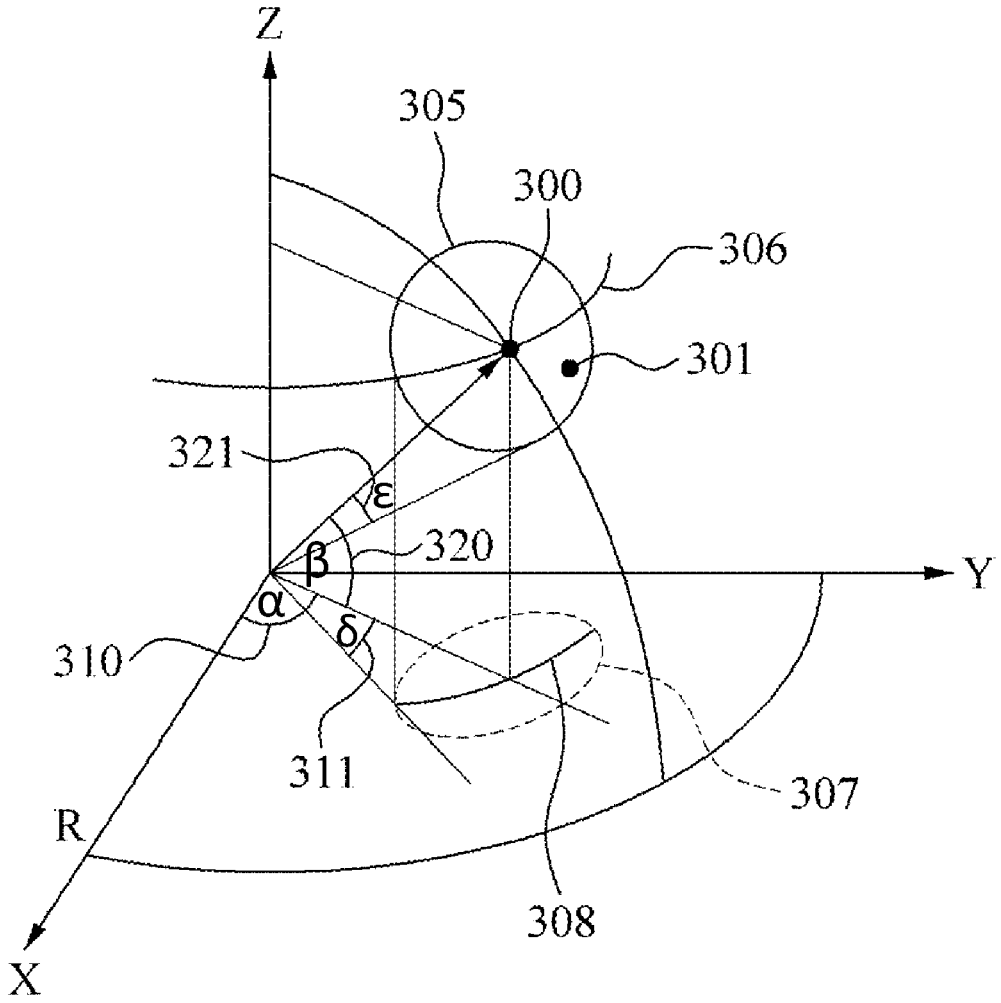
FIG. 3 is a diagram illustrating an effective beam width of an orientation of an antenna of a mobile satellite according to an example embodiment.

FIG. 3 is a diagram illustrating an effective beam width of an orientation of an antenna of a satellite according to an example embodiment. When an antenna of a satellite is oriented correctly to a ground station from a certain point in an orbit of the satellite, an antenna orientation point p 300 may be indicated by p(x,y,z) on three-dimensional (3D) coordinates, and an accurate azimuth α 310 and an accurate elevation β 320 may be calculated based on Equation 1 above using a vector of the antenna orientation point p 300. Here, an area with an angle associated with an effective beam width ε 321 may be formed based on the antenna orientation point p 300, and the area may be represented by a circular range 305 on a sphere that is represented by a radius R in FIG. 3. Since a point p' 301 in the circular range 305 is in the effective beam width ε 321, the ground station positioned on the vector may receive a satellite signal, although the antenna is oriented to the point p' 301 in lieu of the antenna orientation point p 300.

When an elevation $\beta_t$ at a point in time t is fixed to the elevation β 320, a range δ 311 of an azimuth α' within the effective beam width ε 321 may be calculated. When the azimuth α 310 is an original accurate azimuthal angle, an optimal azimuthal angle, which is the azimuth α', may be present within the range δ 311 that may be obtained using the effective beam width ϵ 321, and an upper boundary $\alpha_t^{upper}$ and a lower boundary $\alpha_t^{lower}$ of the range δ 311 of the azimuth α' at the point in time t in a section for communication may be calculated based on Equation 2 below.

$$\alpha_t' = \alpha_t + \Delta\alpha_t,\ |\Delta\alpha_t| < \delta_t, \text{ for fixed elevation } \beta_t \qquad \text{[Equation 2]}$$

$$\delta_t = 2\sin^{-1}\left(\frac{\sin(\frac{\varepsilon}{2})}{|\cos(\beta_t)|}\right)$$

$$\alpha_t^{upper} - \alpha_t + \delta_t$$

$$\alpha_t^{lower} = \alpha_t - \delta_t$$

Referring to FIG. 3, in a case of an elevation within an effective beam width different from the effective beam width ε 321 for the original accurate elevation β 320, a range of an azimuth α' within the corresponding effective beam width may also be calculated. The range δ 311 may be obtained by projecting, onto an XY plane, the circular range 305 on the sphere and a large circular arc 306 passing the circular range 305, for example, the circular arc 306 on the sphere passing through a center of the circular range 305. As illustrated in FIG. 3, the circular range 305 may be projected as an ellipse 307 on the XY plane, and the circular arc 306 may be projected as a circular arc 308 on the XY plane.

Figure 4A:
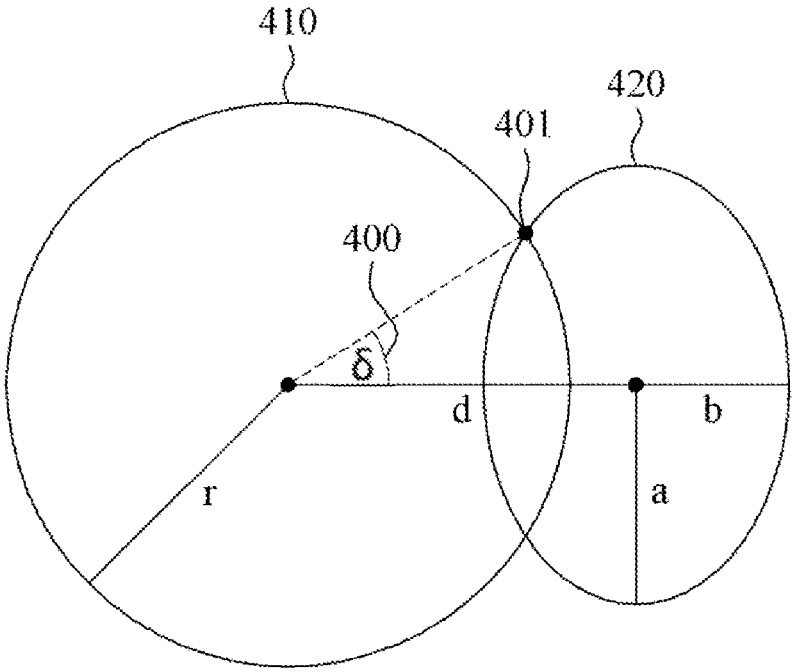
FIGS. 4A and 4B are diagrams illustrating an azimuth range for an effective beam width with respect to an elevation at a point in time according to an example embodiment.
Figure 4B:
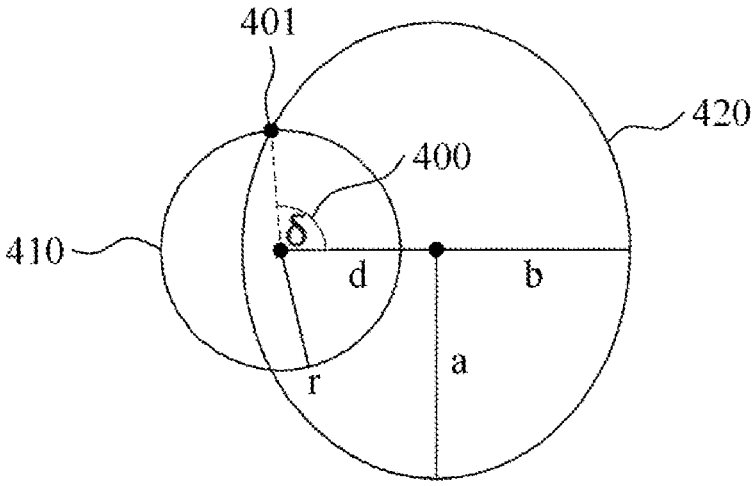

FIGS. 4A and 4B are diagrams illustrating an azimuth position range for an effective beam width with respect to an elevation at a point in time according to an example embodiment. Two methods may be applied based on an elevation β and a size of an effective beam width ε. Equation 2 is used to calculate a range of an azimuth α' using an accurate elevation β, and Equation 3 below is used to calculate a range of an azimuth α' within an effective beam width with respect to an elevation β' at a certain point in time, or within a range satisfying an effective beam width of an antenna based on a vector of an accurate antenna orientation.

When a sum of an accurate elevation β and an effective beam width ε is less than 90°, a range of an azimuth α' may be calculated with reference to FIG. 4A. When the sum of the accurate elevation β and the effective beam width ε is greater than or equal to 90°, the range of the azimuth α' may be calculated with reference to FIG. 4B. Referring to FIG. 4A, a circle 410 with a radius r may be obtained by projecting, onto an XY plane, a circular arc passing a center of an effective beam width circle on a sphere, and the effective beam width circle projected on the XY plane may become an ellipse 420 with an axial length (a,b). Here, a distance d may be formed between a center of the circle 410 and a center of the ellipse 420. A range δ 400 may be represented by an angle, and a value of the range δ 400 may be determined based on an intersection point 401 between the circle 410 and the ellipse 420. In detail, the value may be obtained using Equation 3 below.

[Equation 3]

$$2R\sin\left(\frac{\varepsilon}{2}\right) = 2R\cos(\beta)\sin\left(\frac{\delta}{2}\right)$$

$$\Delta\alpha < \delta, \text{ for fixed elevation } \beta$$

$$\delta = \Delta\alpha_{max}^{\beta} = 2\sin^{-1}\left(\frac{\sin\left(\frac{\varepsilon}{2}\right)}{|\cos(\beta)|}\right)$$

$$p = (\alpha, \beta)$$

$$p' = (\alpha', \beta'), \text{ for } \beta - \varepsilon < \beta' < \beta + \varepsilon$$

$$r = R\cos(\beta')$$

$$d = R\cos(\varepsilon)\cos(\beta)$$

$$a = R\sin(\varepsilon)$$

$$b = R\sin(\varepsilon)\sin(\beta)$$

$$x - \frac{a^2 d - \sqrt{a^4 d^4 - (a^2 - b^2)(a^2 d^2 + b^2 r^2 - a^2 b^2)}}{a^2 - b^2}$$

$$y = \sqrt{a^2 - b^2}$$

$$\Delta\alpha_{max}^{\beta'} = \tan^{-1}\left(\frac{y}{x}\right), \text{ limited between } 0° \text{ and } 180°$$

In Equation 3, the intersection point 401 is denoted as (x,y), and the range δ 400 may be obtained. In the example illustrated in FIG. 4B, the range δ 400 of the azimuth α' may also be obtained using Equation 3.

Figure 5:
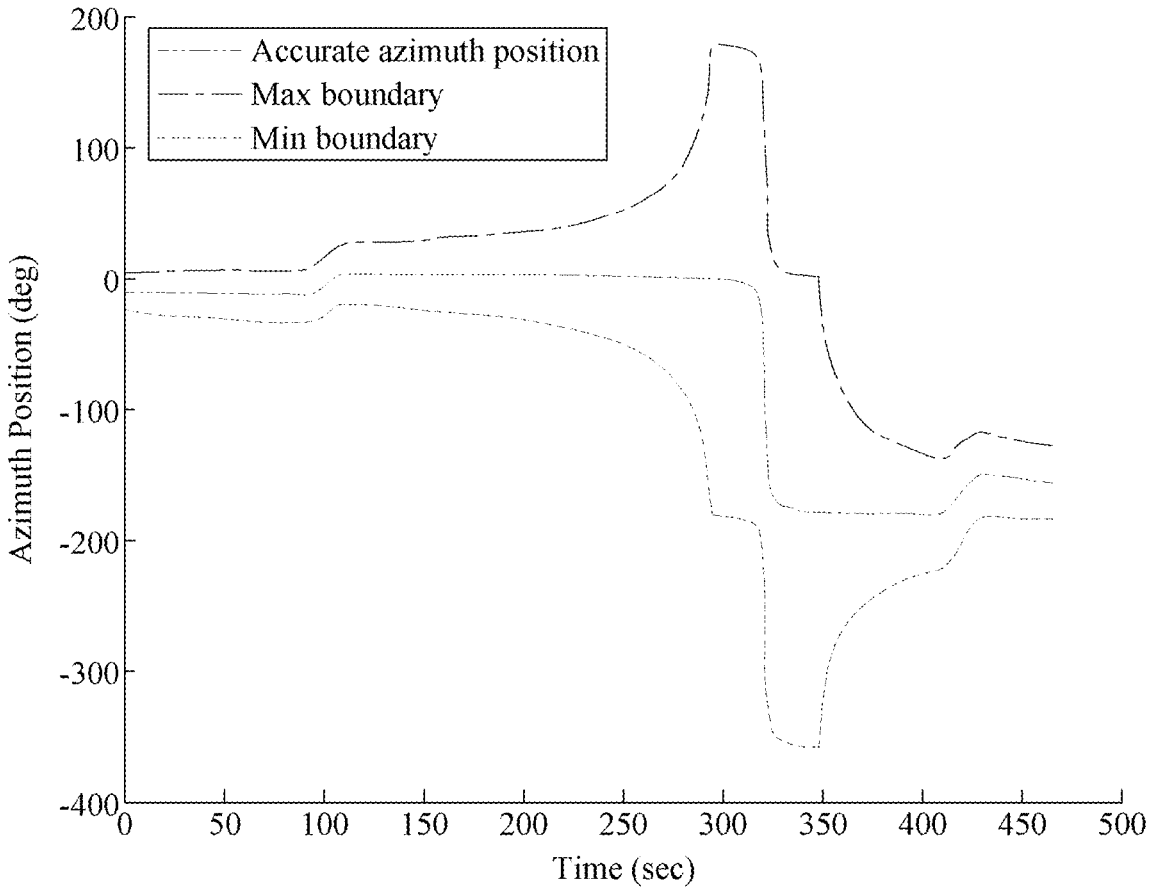
FIG. 5 is an example graph illustrating an azimuth position range according to an example embodiment.

FIG. 5 is an example graph illustrating an azimuth position range according to an example embodiment. In the graph of FIG. 5, an azimuth position range δ calculated based on Equations 2 and 3 above is illustrated with respect to a time section for communication (or a communication section t as used hereinafter). In the graph, an alternate long and two short dashes line indicates an accurate azimuth position, which is an azimuth value when an antenna of a mobile satellite is correctly oriented to a ground station. Based on such an azimuth position, an azimuth position range that satisfies an effective range may be formed, and the azimuth position range may include an upper boundary (or a max boundary indicated by an alternate long and short dash line in FIG. 5) and a lower boundary (or a min boundary indicated by a broken line in FIG. 5). When the antenna of the satellite is located in a range greater than the lower boundary and less than the upper boundary, although the antenna is not located at the accurate azimuth position, the ground station may receive a signal transmitted from the satellite. Thus, an effective azimuth position range at a time t in the communication section may be determined as illustrated in the graph of FIG. 5. A driving speed of the antenna of the satellite may be controlled based on a value selected within the azimuth position range. A method of generating an optimized azimuth profile that may minimize an azimuthal velocity within the azimuth position range will be described in detail with reference to FIG. 9.

Figure 6:
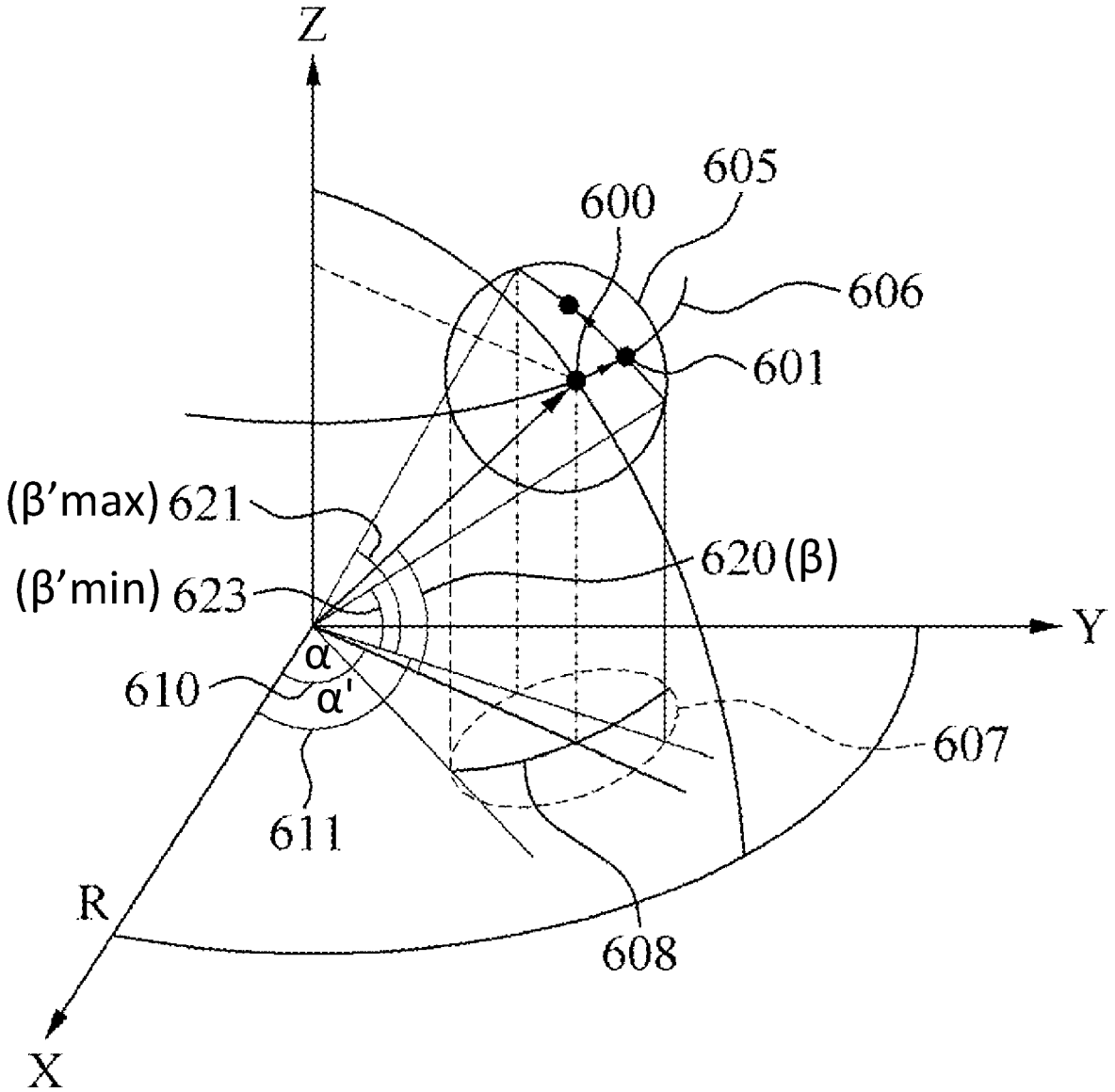
FIG. 6 is a diagram illustrating a maximum elevation and a minimum elevation with respect to an azimuth within an effective beam width of an orientation of an antenna of a mobile satellite according to an example embodiment.

As described above, after an accurate elevation is fixed (or set) first, an azimuth position range that satisfies an effective beam width may be calculated. A suitable azimuth profile may then be selected from the azimuth position range, and an elevation position range may be calculated. FIG. 6 is a diagram illustrating a maximum elevation and a minimum elevation with respect to an azimuth within an effective beam width at an orientation of an antenna of a satellite to calculate an elevation position range according to an example embodiment.

Referring to FIG. 6, an accurate azimuth α 610 and an accurate elevation β 620 may be calculated with respect to an antenna orientation point p 600 of an antenna of a satellite at which the antenna is correctly oriented to a ground station, using Equation 1 above. A range that satisfies an effective beam width with respect to the accurate elevation β 620 may be represented by a circle 605 on a sphere with a radius R. Although the antenna of the satellite is oriented to another point p' 601 in the circle 605, the ground station positioned in a vector of the antenna orientation point p 600 may receive a signal transmitted from the satellite. In FIG. 6, when an optimized azimuth within an area that satisfies the effective beam width is a' 611, an elevation position range including $\beta'_{max}$ 621 and $\beta'_{min}$ 623 that is effective with respect to the azimuth a' 611 may be obtained. A range in which an elevation changes may be obtained using two methods, for example, methods illustrated FIGS. 7A and 7B, based on an effective beam width ε and a size of an accurate elevation β.

Figure 7A:
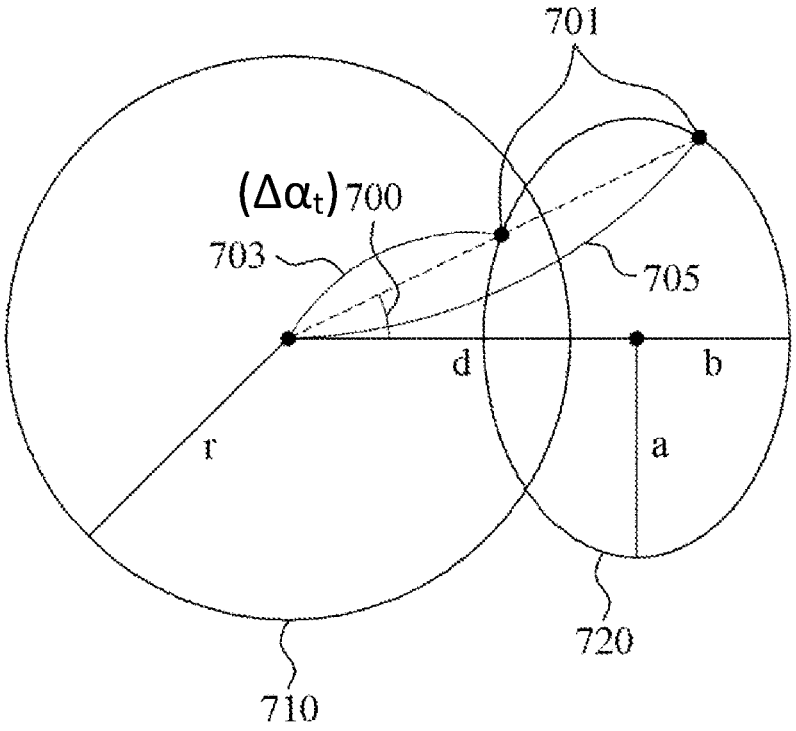
FIGS. 7A and 7B are diagrams illustrating an elevation range for an effective beam width with respect to an azimuth according to an example embodiment.
Figure 7B:
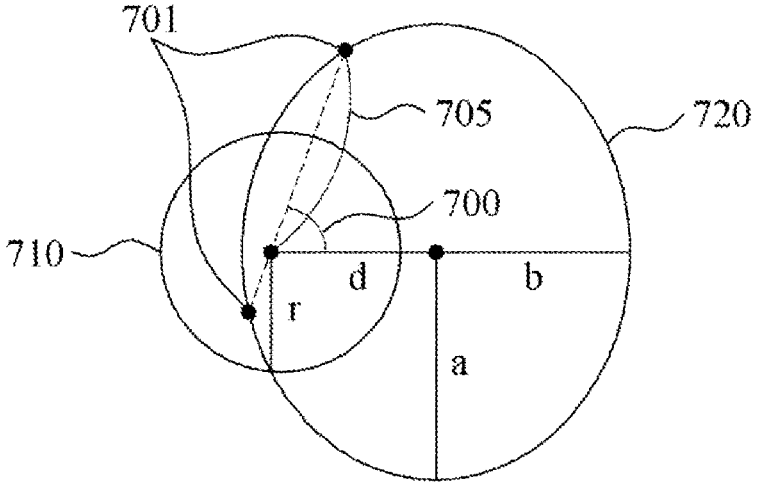

FIGS. 7A and 7B are diagrams illustrating an elevation position range for an effective beam width with respect to an azimuth according to an example embodiment. FIG. 7A illustrates a case in which a sum of an accurate elevation β and an effective beam width ε is less than 90°, and FIG. 7B illustrates a case in which a sum of the accurate elevation β and the effective beam width ε is greater than or equal to 90°. Referring to FIG. 7A, a circular arc projected on an XY plane may become a circle 710 with a radius r, and an effective beam width circle projected on the XY plane may become an ellipse 720 with an axial length (a, b). Here, a distance d between a center of the circle 710 and a center of the ellipse 720 may be formed. When an azimuth is fixed (or set) as an optimized angle $\Delta\alpha_t$ 700, an effective elevation change may be projected onto the XY plane as straight lines $I_{\beta'max}$ 703 and $I_{\beta'min}$ 705, and an upper boundary $\beta_t^{upper}$ and a lower boundary $\beta_t^{lower}$ in an elevation position range may be calculated using two intersection points 701 at which the straight lines $I_{\beta'max}$ 703 and $I_{\beta'min}$ 705 meet the ellipse 720 obtained by projecting the effective beam width circle onto the XY plane, based on Equation 4 below.

[Equation 4]

$$\Delta\alpha_t = \alpha_t' - \alpha_t$$

$$x = \frac{a^2 d \pm \sqrt{a^4 d^2 - (a^2 + b^2\tan^2(\Delta\alpha_t))(a^2 d^2 - a^2 b^2)}}{a^2 + b^2\tan^2(\Delta\alpha_t)}$$

$$y = x\tan(\Delta\alpha_t)$$

-continued $$x_{\beta'_{max}} = \begin{cases} \underset{x}{\operatorname{argmax}} |x^2 + y^2|, \text{ if } \beta < 90° - \varepsilon \\ \underset{x}{\arg} \operatorname{sign}(x) \text{equals to } \operatorname{sign}(\cos(\Delta\alpha_t)), \text{ else} \end{cases}$$

$$x_{\beta'_{max}} = \begin{cases} \underset{x}{\operatorname{argmin}} |x^2 + y^2|, \text{ if } \beta < 90° - \varepsilon \\ 0, \text{ else} \end{cases}$$

$$l_{\beta'_{max}} = x_{\beta'_{max}} \sqrt{1 + \tan^2(\Delta\alpha_t)}$$

$$l_{\beta'_{min}} = x_{\beta'_{min}} \sqrt{1 + \tan^2(\Delta\alpha_t)}$$

$$\beta_t^{upper} = \beta'_{max} = \cos^{-1}\left(\frac{l_{\beta'_{max}}}{R}\right)$$

$$\beta_t^{lower} = \beta'_{min} = \cos^{-1}\left(\frac{l_{\beta'_{min}}}{R}\right)$$

Figure 8:
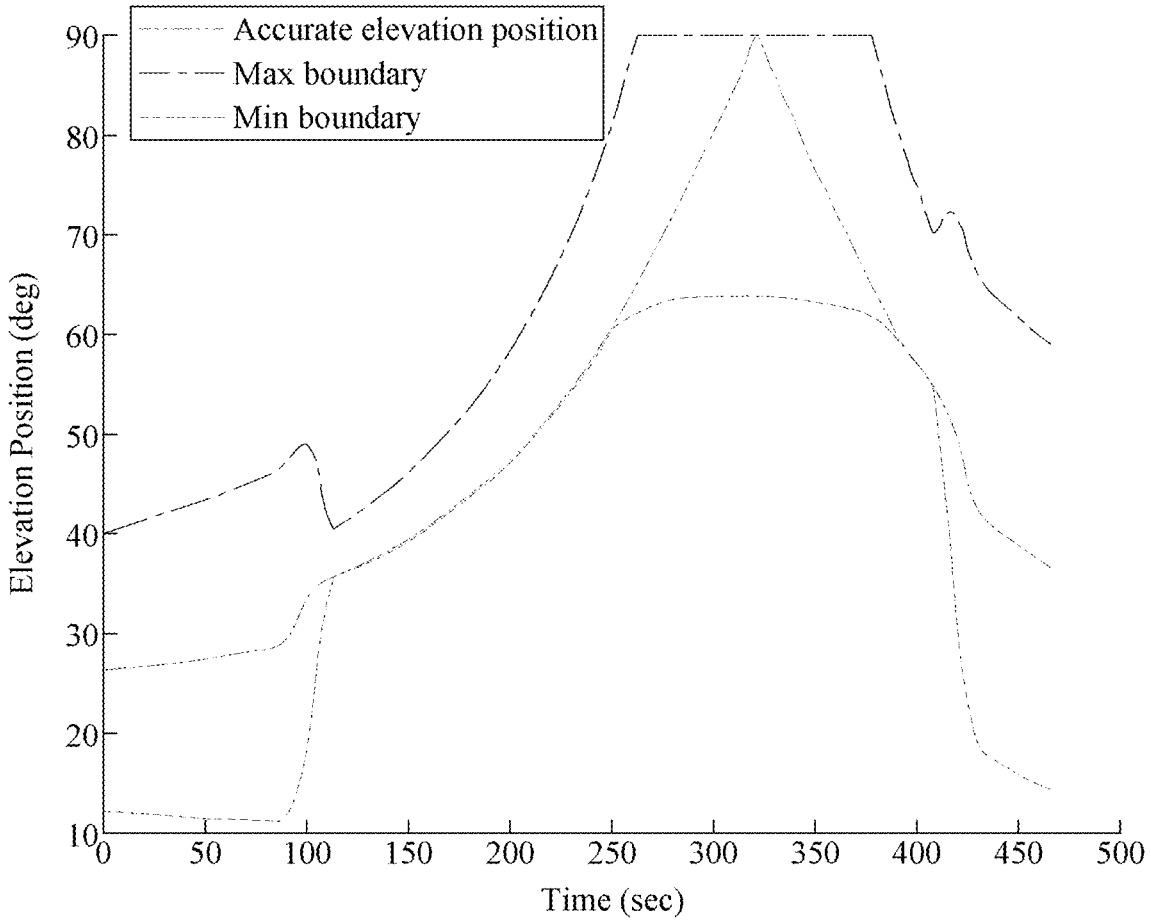
FIG. 8 is an example graph illustrating an elevation position range according to an example embodiment.

FIG. 8 is an example graph illustrating an elevation position range according to an example embodiment. An effective elevation position range including an upper boundary, for example, $\beta'_{max}$ 621, and a lower boundary, for example, $\beta'_{min}$ 623, which is calculated based on Equation 4 above, may be represented with respect to a communication section as shown in the graph illustrated in FIG. 8. In the graph, an alternate long and two short dashes line indicates an accurate elevation position, which is an elevation value when an antenna of a mobile satellite is oriented correctly to a ground station. The elevation position range for an effective beam width based on the accurate elevation position may include an upper boundary (or a max boundary indicated by an alternate long and short dash line in FIG. 8) and a lower boundary (or a min boundary indicated by a broken line in FIG. 8). When the antenna of the satellite is located in a range greater than the lower boundary and less than the upper boundary, although the antenna is not located at the accurate elevation position, the ground station may receive a signal transmitted from the satellite. Thus, an effective elevation position range at a time t in the communication section may be determined as shown in the graph illustrated in FIG. 8.

When an elevation is closer to 90°, a rapid change in terms of velocity associated with an azimuth may occur. Referring to FIG. 8, in a time section between 300 seconds (sec) and 350 sec, an accurate elevation value is 90°, and thus such a rapid change may exceed a dynamic limit of the antenna or generate a jitter. However, the upper boundary of the elevation position range that is calculated according to an example embodiment may be 90° in a time section between 250 sec and 370 sec because the upper boundary depends on the accurate elevation position, and the lower boundary may be approximately 60° in the time section. Thus, when an elevation value is determined at a position greater than the lower boundary and less than the upper boundary, the dynamic limit of the antenna may be satisfied and a jitter may not occur. Therefore, a driving speed of the antenna of the satellite may be effectively controlled using a value selected from the elevation position range. A method of generating an optimized elevation profile that may minimize a velocity associated with an elevation within an elevation position range will be described in detail with reference to FIG. 9.

Referring back to FIG. 2, the calculator 210 includes a path profile generator 215 configured to generate, using an upper boundary including a maximum value of an azimuth position range or an elevation position range, a lower boundary including a minimum value of the azimuth position range or the elevation position range, a start point of an orbit in which a mobile satellite is to travel, and an end point of the orbit, a shortest path having a shortest total distance among a plurality of paths extending from the start point to the end point and having a value greater than the lower boundary and less than the upper boundary.

The path profile generator 215 may calculate the shortest path having the shortest total distance, using a shortest path algorithm. The shortest path algorithm include various types, and a representative shortest path algorithm may include a Dijsktra algorithm and a A* algorithm. Since the Dijkstra algorithm is based on a search and consumes a relatively greater amount of time for calculation or computation although the Dijkstra algorithm obtains the shortest path permanently, the Dijkstra algorithm may be used to various application fields that are not restricted by a time limit. For example, in a desktop computer, the Dijkstra algorithm may consume approximately 6 seconds in calculating an optimal or shortest path in an orbit in a 500 sec time section. However, when an on-board computer that is equipped in a satellite is used, a significantly greater amount of time may be consumed for calculation or computation due to a lower calculation speed, compared to the desktop computer, and thus a traveling speed of the satellite may be affected. According to an example embodiment, the path profile generator 215 may calculate the shortest path using a method that reduces a time for calculation to approximately 1/200 (or 0.03 sec consumed) compared to the time used for the calculation performed by the Dijkstra algorithm.

Figure 9:
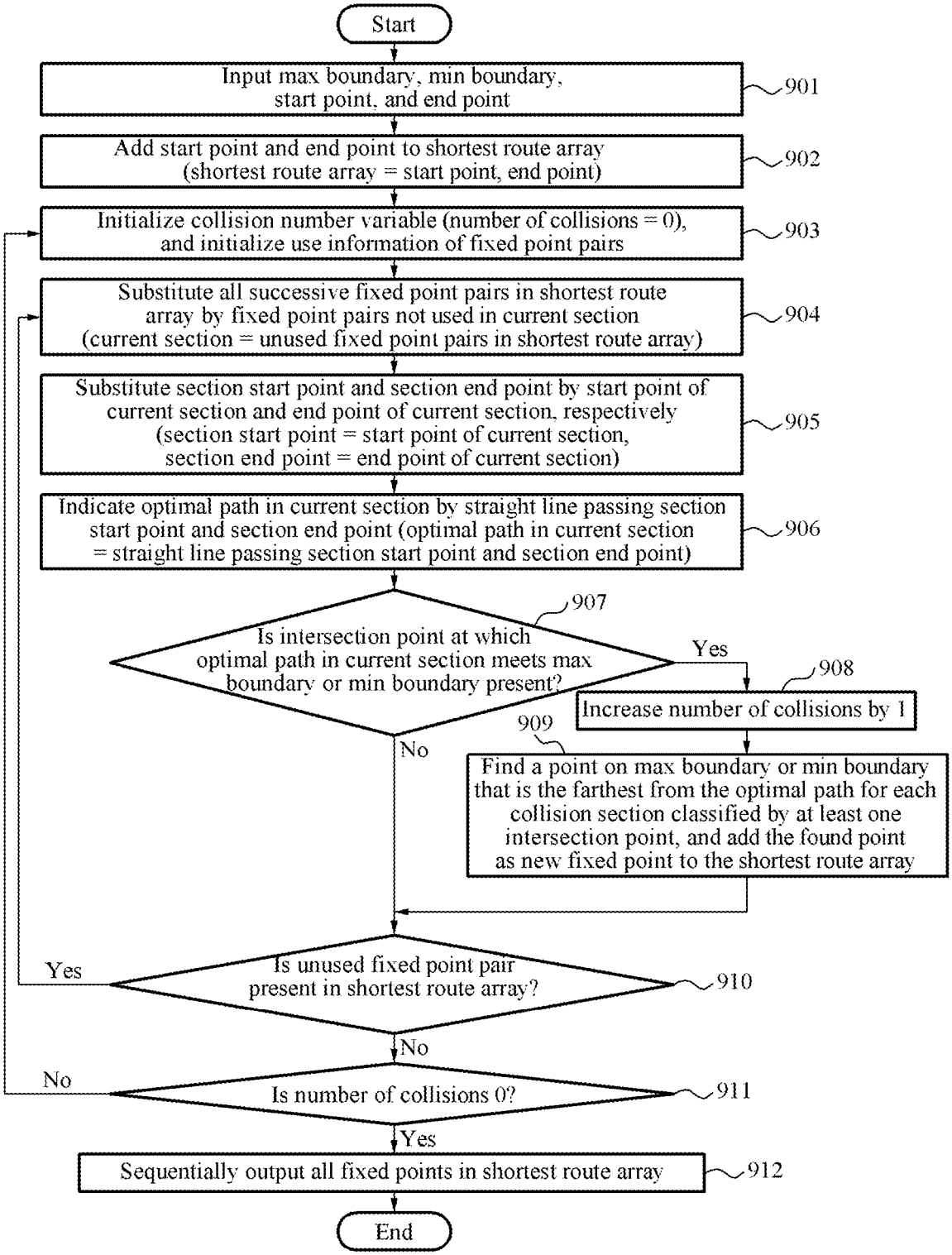
FIG. 9 is a flowchart illustrating a method of generating a shortest path in a position range according to an example embodiment.

FIG. 9 is a flowchart illustrating a method of generating a shortest path in a position range according to an example embodiment. For convenience of description, an algorithm to be described with reference to FIG. 9 will be referred to as a string nailing algorithm.

Input data of the string nailing algorithm may include a position range that is represented by an upper boundary and a lower boundary, and a start point and an end point of a shortest path, and may be used to obtain output data to select a path having a shortest total distance from a plurality of paths in the position range and extending from a start point to an end point of an orbit.

A method of selecting the shortest path by the path profile generator 215 may be applicable to a position range calculated by each of the azimuth position range calculator 211 of FIG. 2 and the elevation position range calculator 213 of FIG. 2. Hereinafter, a method of selecting a shortest path extending from a start point of an orbit to an end point of the orbit with respect to an azimuth position range will be described.

Figure 10:
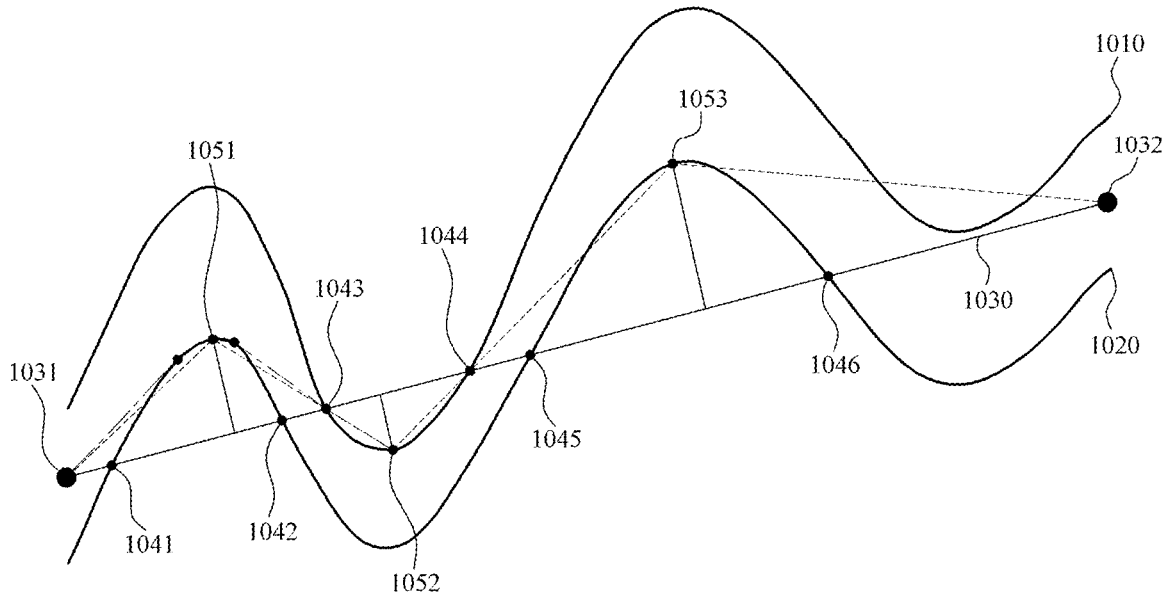
FIG. 10 is a diagram illustrating a method of generating a shortest path in a position range according to an example embodiment.

Referring to FIG. 9, in operation 901, an upper boundary (or a max boundary as illustrated) including a maximum value of an azimuth position range and a lower boundary (or a min boundary as illustrated) including a minimum value of the azimuth position range, and a start point of an orbit in a communication section and an end point of the orbit are received as an input. FIG. 10 is a diagram illustrating a method of generating a shortest path in a position range according to an example embodiment. Referring to FIG. 10, examples of an upper boundary 1010 and a lower boundary 1020, and a start point 1031 and an end point 1032 are illustrated.

In the string nailing algorithm, a shortest route array refers to a set of fixed points included in the shortest route. A fixed point may be an azimuth position (or point) or an elevation position (or point) of a target for which a value of a position in an orbit is calculated based on a time. Referring to FIGS.

9 and 10, in operation 902, the start point 1031 and the end point 1032 of the orbit are added as new fixed points to the shortest route array, and initialization is performed on the shortest route array.

In operation 903, to obtain a path within a range for the upper boundary and the lower boundary, a collision number variable that indicates the number of intersection points at which an optimal path obtained as a straight line meets the boundaries is initialized to be 0. In this operation, use information of all fixed point pairs in the shortest route array is initialized to be unused.

In operation 904, successive two fixed points in the shortest route array that are not used in a current section are substituted for all successive fixed point pairs in the shortest route array. Here, a pair of unused fixed points refers to a pair of successive fixed points in a time order that are not substituted in the current section. Since only the start point and the end point are initially present in the shortest route array, the successive fixed points to be initially substituted in the current section may be the start point and the end point. Referring to FIG. 10, the current section may be a section between a fixed point 1031 and a successive fixed point 1032.

In operation 905, a start point of the current section and an end point of the current section are substituted for a section start point and a section end point, respectively.

In operation 906, an optimal path in the current section is indicated by a straight line passing the section start point and the section end point. Referring to FIG. 10, a straight line 1030 passing the fixed point 1031 and the fixed point 1032 is an optimal path in the current section.

In operation 907, whether an intersection point at which the optimal path in the current section meets the upper boundary or the lower boundary is present is determined. In the presence of the intersection point (indicated by "Yes" in operation 907), the collision number variable increases by 1 in operation 908. In operation 909, a point in the upper boundary or the lower boundary that is separated farthest from the optimal path is discovered for each collision section that is classified by at least one intersection point, and the discovered point is added to the shortest route array as a new fixed point. Here, the collision section refers to a section that deviates from the upper boundary or the lower boundary. Referring to FIG. 10, the number of intersection points at which the straight line 1030, which is the optimal path in the current section, meets the upper boundary 1010 or the lower boundary 1020 is six, for example, intersection points 1041, 1042, 1043, 1044, 1045, and 1046. Sections to be classified by these six intersection points may include, for example, a section between the points 1031 and 1041, a section between the points 1041 and 1042, a section between the points 1042 and 1043, a section between the points 1043 and 1044, a section between the points 1044 and 1045, a section between the points 1045 and 1046, and a section between the points 1046 and 1032. Among these sections, the collision sections, which are sections deviating from the upper boundary and the lower boundary, may include, for example, the section between the points 1041 and 1042, the section between the points 1043 and 1044, and the section between the points 1045 and 1046. A point in the upper boundary or the lower boundary that is separated farthest from the optimal path in the collision section may be discovered. For example, as illustrated in FIG. 10, in the section between the points 1041 and 1042, a point 1051 in the lower boundary 1020 that is separated farthest from the straight line 1030, which is the optimal path, may be discovered. In the section between the points 1043 and 1044, a point 1052 in the upper boundary 1010 may be discovered. In the section between the points 1045 and 1046, a point 1053 in the lower boundary 1020 may be discovered. These three intersection points 1051, 1052, and 1053 may be added to the shortest path array as new fixed points.

In operation 907, when the intersection point is not present (indicated by "No" in operation 907), or when the intersection point is present (indicated by "Yes" in operation 907), operation 910 is performed through operations 908 and 909. In operation 910, whether an unused fixed point pair is remained in the shortest path array is determined. In the presence of the unused fixed point pair (indicated by "Yes" in operation 910), operation 904 is performed again and operations 904 through 910 are performed repeatedly on the unused fixed point pair. In the absence of the unused fixed point pair (indicated by "No" in operation 910), operation 911 is performed.

In operation 911, whether the collision number variable is 0 is determined. When the collision number variable is not 0, operation 903 is performed to initialize the collision number variable to be 0 and initialize the use information of fixed point pairs, and generate again an optimal path based on all successive fixed points in the shortest path array. Referring to FIG. 10, an operation of substituting the two successive fixed points 1031 and 1051 in the shortest route array for the current section, discovering an intersection point in the optimal path, which is a straight line indicated by a broken line, in the current section, and discovering a new fixed point in a collision section among sections classified by the intersection point may be repeated.

When the collision number variable is 0 in operation 911, all fixed points in the upper boundary and the lower boundary are discovered, and thus operation 912 is performed to sequentially output all the fixed points in the shortest route array. Since the shortest route array includes a fixed point indicating a value of a position of an azimuth or an elevation in an orbit that forms the shortest path, data obtained by sequentially outputting all the fixed points in the shortest route array may be a value of a position of an azimuth or an elevation based on a communication time for the shortest path.

Figure 11:
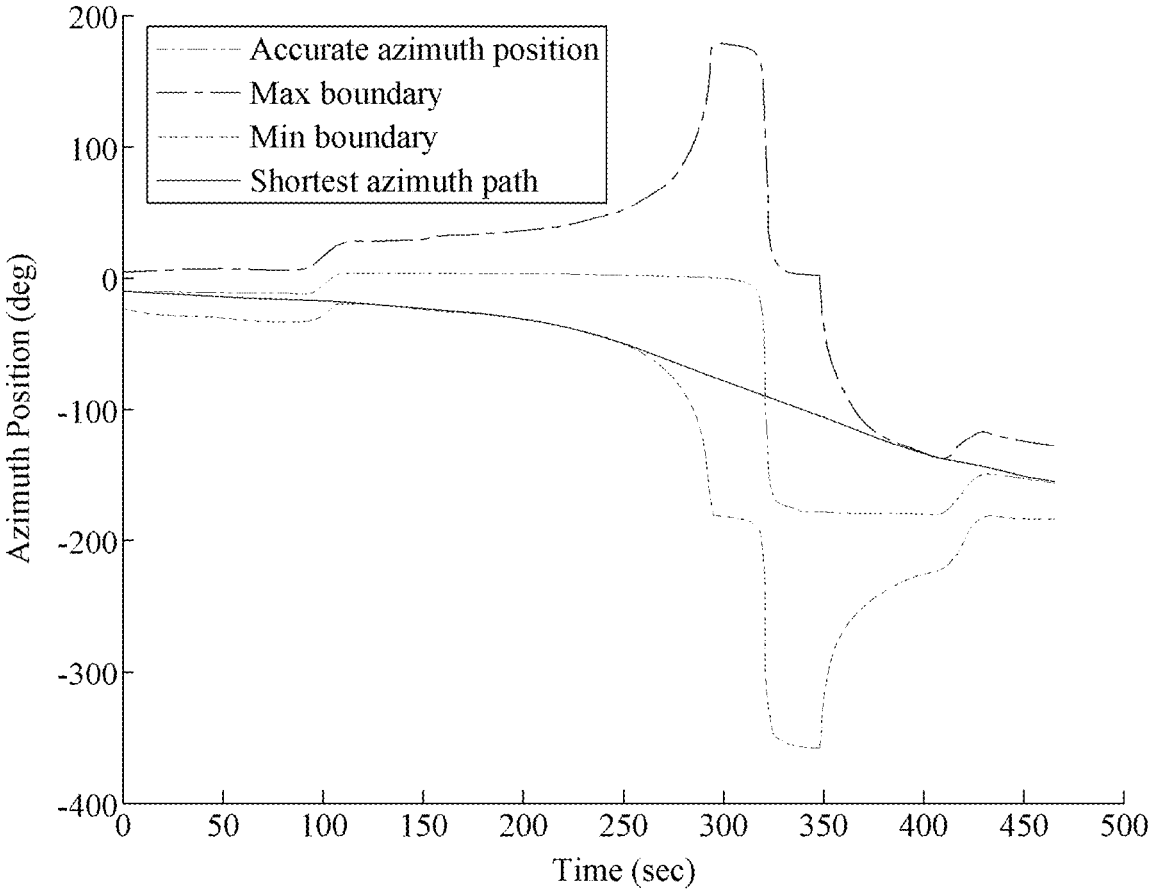
FIG. 11 is a graph illustrating a minimum azimuth path in an azimuth position range according to an example embodiment.

FIG. 11 is a graph illustrating a minimum azimuth path in an azimuth position range according to an example embodiment. The graph illustrated in FIG. 11 is an example of a result of obtaining a minimum azimuth path as illustrated in FIG. 5 based on the algorithm described with reference to FIG. 9. Referring to FIG. 11, the minimum azimuth path (indicated by a solid line) is present within an upper boundary (or a max boundary indicated by an alternate long and short dash line) and a lower boundary (or a min boundary indicated by a broken line), and corresponds to a shortest path having a shortest total distance.

Figure 12:
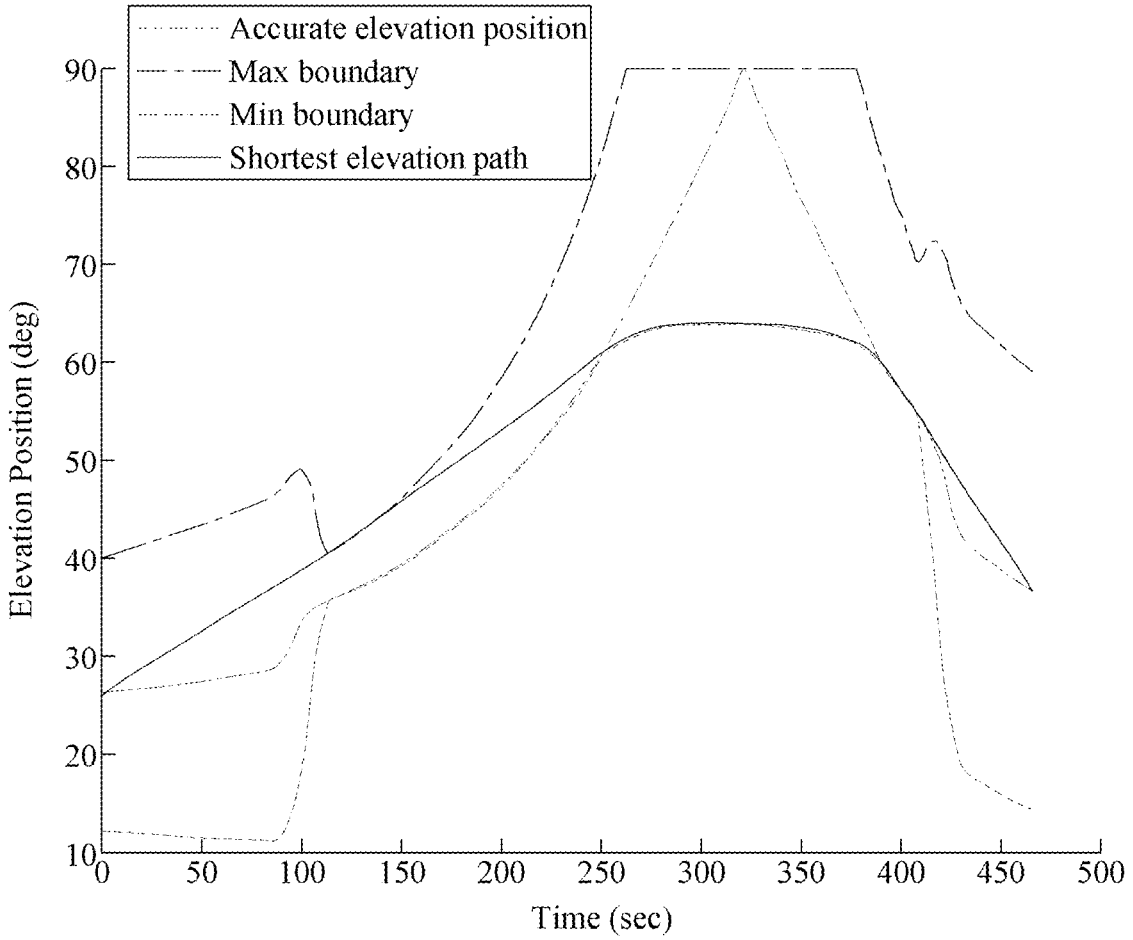
FIG. 12 is a graph illustrating a minimum elevation path in an elevation position range according to an example embodiment.

FIG. 12 is a graph illustrating a minimum elevation path in an elevation position range according to an example embodiment. A minimum elevation path may be calculated based on the algorithm described with reference to FIG. 9. Referring to FIG. 12, the minimum elevation path (indicated by a solid line) is present within an upper boundary (or a max boundary indicated by an alternate long and short dash line) and a lower boundary (or a min boundary indicated by a broken line), and corresponds to a shortest path having a shortest total distance. As described above, the shortest path may be selected based on an accurate elevation or a maximum elevation that is close to 90° in a section between 250 sec and 370 sec. Dissimilar to the description provided in the foregoing, the shortest path may be selected based on a value close to a minimum boundary value as a minimum value.

Thus, when a driving speed of an antenna of a mobile satellite is controlled based on an elevation profile as indicated in the graph of FIG. 12, a requirement for a dynamic limit of the antenna may be satisfied and a jitter may not occur.

Figure 13:
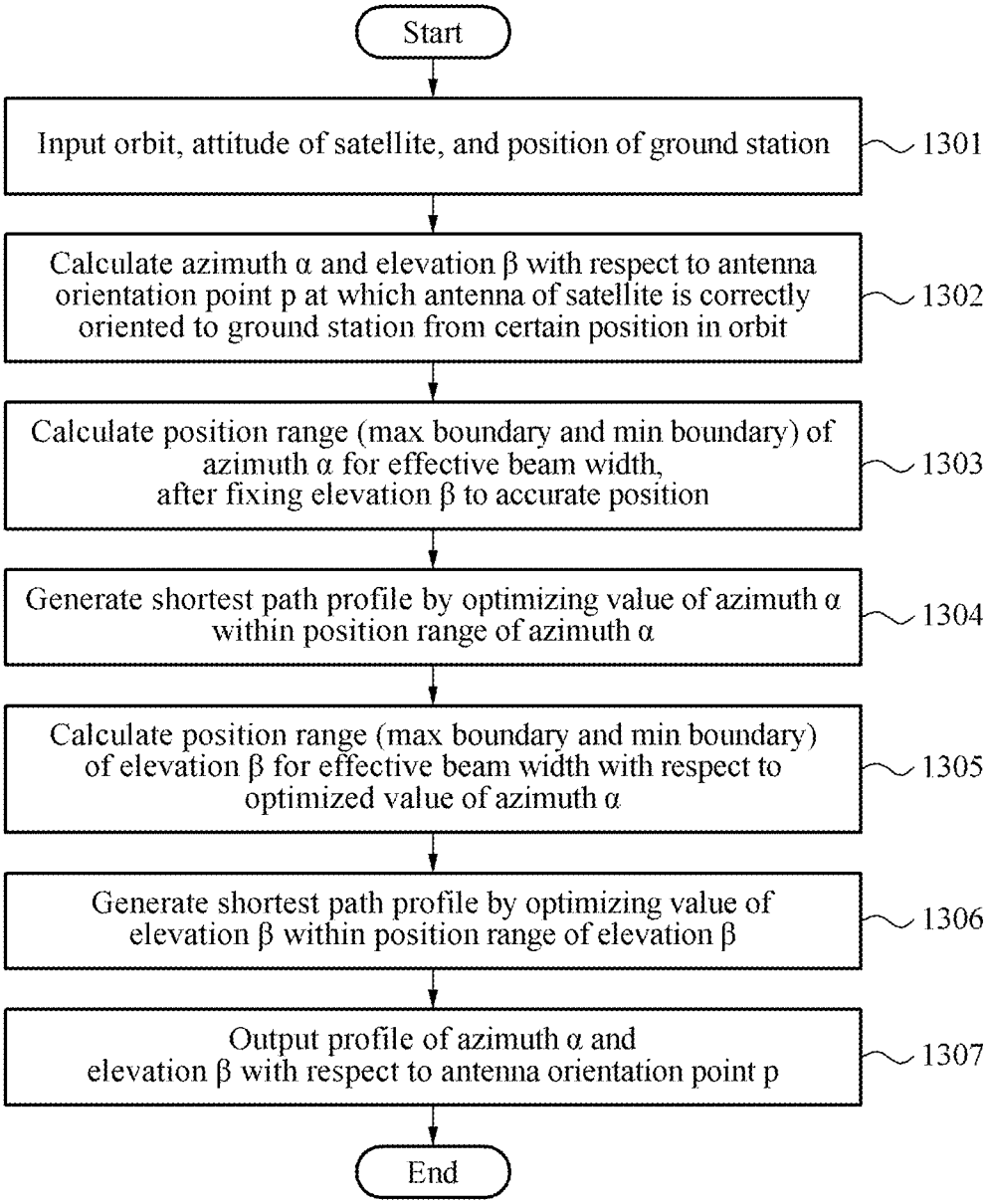
FIG. 13 is a flowchart illustrating a method of controlling a driving speed of an antenna of a mobile satellite according to an example embodiment.

FIG. 13 is a flowchart illustrating a method of controlling a driving speed of an antenna of a mobile satellite according to an example embodiment. When the antenna of the satellite is correctly oriented to a ground station from a certain point in an orbit of the satellite, an azimuth position range and an elevation position range for an effective beam width formed based on an antenna orientation point p may be calculated, a shortest path in the azimuth position range and the elevation position range may be discovered, and a path profile including an azimuth value and an elevation value may be generated based on the discovered shorted path.

In detail, referring to FIG. 13, in operation 1301, information on an orbit in which a mobile satellite desires to travel, an attitude of the satellite, and a position of a ground station is input.

In operation 1302, an azimuth a and an elevation β with respect to an antenna orientation point p at which an antenna of the satellite is correctly oriented to the ground station from a certain point in the orbit along which the satellite travels are calculated using Equation 1 above.

In operation 1303, after the elevation β is fixed to an accurate position, for example, after a value obtained based on Equation 1 is substituted and used as an invariable, a position range of the azimuth α (a boundary corresponding to a maximum value and a minimum value) for an effective beam width formed based on the antenna orientation point p is calculated using Equation 2 above.

In operation 1304, an azimuth at which the antenna has a minimum speed within the position range of the azimuth α is selected. Here, a general shortest path algorithm may be used, or a minimum azimuth path may be obtained using a string nailing algorithm according to an example embodiment.

In operation 1305, a position range of the elevation β (a boundary corresponding to a maximum value and a minimum value) for the effective beam width with respect to a value optimized by minimizing a value of the azimuth αis calculated. Here, the position range may be obtained using Equation 4.

In operation 106, a shortest path profile is generated by optimizing a value of the elevation β in the position range of the elevation β. A minimum elevation path may be obtained through the string nailing algorithm according to an example embodiment.

In operation 1307, the azimuth a and the elevation β selected to be included in a shortest path with respect to the antenna orientation point p are output.

Here, there may need to fix a speed of the antenna to be constant in a certain section. For example, in a case that an angular velocity of the antenna at which a jitter may occur is distributed into various values, the antenna may need to operate while maintaining a certain angular velocity among the values at which a jitter does not occur. Thus, a fixed (or set) angular velocity in a certain section may be obtained by partially changing an obtained azimuth position range and an obtained elevation position range.

Referring back to FIG. 2, the calculator 210 includes a first velocity optimizer (not shown) configured to obtain a fixed angular velocity in a section. The first velocity optimizer may calculate an upper boundary including a maximum value of an azimuth position range or an elevation position range, and a lower boundary including a minimum value of the azimuth position range or the elevation position range. The first velocity optimizer may then extract, from the upper boundary or the lower boundary, a first section in which the fixed angular velocity needs to be maintained, for example, an image capturing section. The fixed angular velocity may be obtained by changing the upper boundary or the lower boundary corresponding to the extracted first section based on a velocity limit.

Figure 14A:
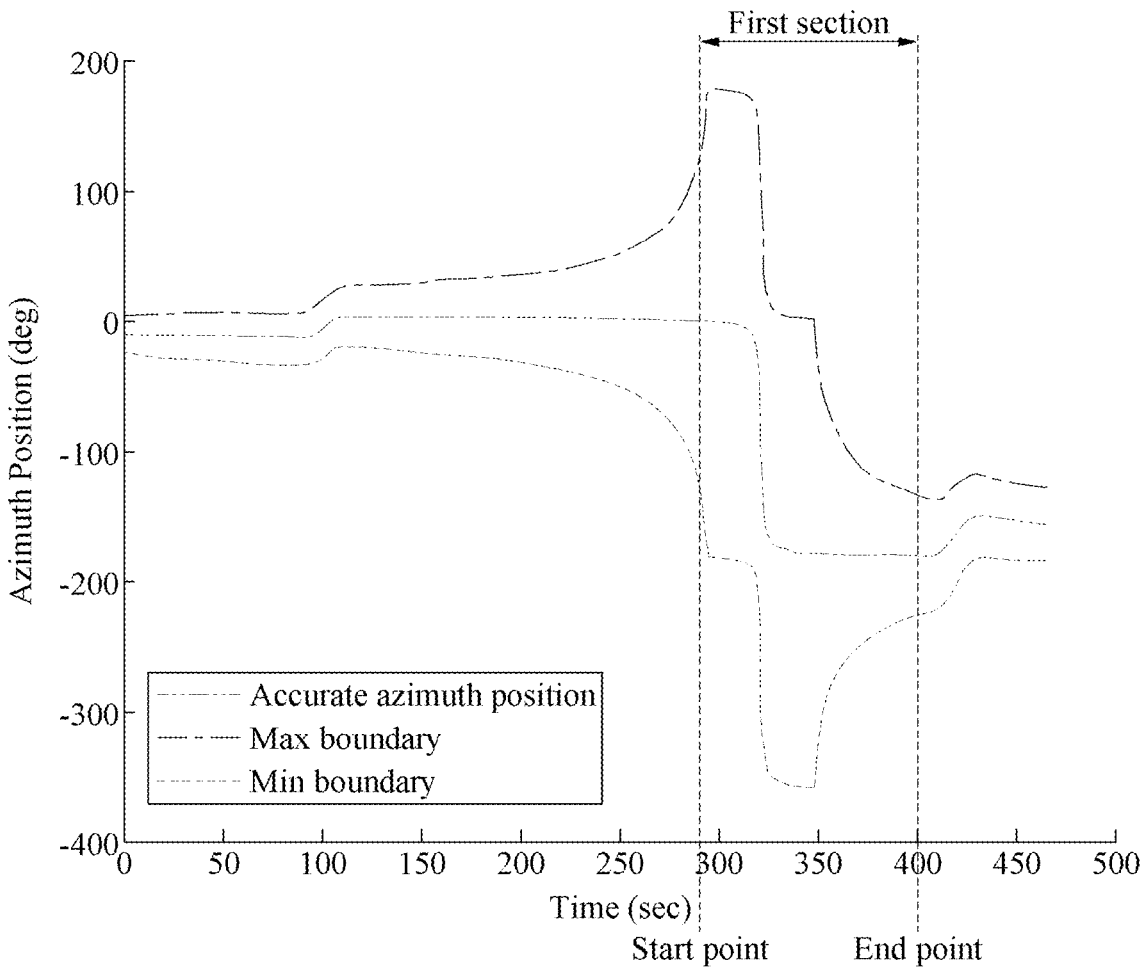
FIG. 14A is an example graph illustrating an elevation position range and a section in which an angular velocity needs to be set for velocity optimization and maintenance of a specific angular velocity according to an example embodiment.

FIG. 14A is an example graph illustrating an elevation position range and a section in which an angular velocity needs to be set for velocity optimization and maintenance of a specific angular velocity according to an example embodiment. Referring to FIG. 14A, to fix (or set) an angular velocity of an antenna in an original upper boundary and an original lower boundary to be a 1 deg/sec, a first velocity optimizer may determine a first section in which an angular velocity is fixed. For example, a section in which an image is obtained, for example, an image capturing section, may be set to be the first section, and as illustrated in FIG. 14A, a section between a start point of image capturing, for example, about 290 sec, and an end point of the image capturing, for example, about 400 sec, may be set to be the first section.

Figure 14B:
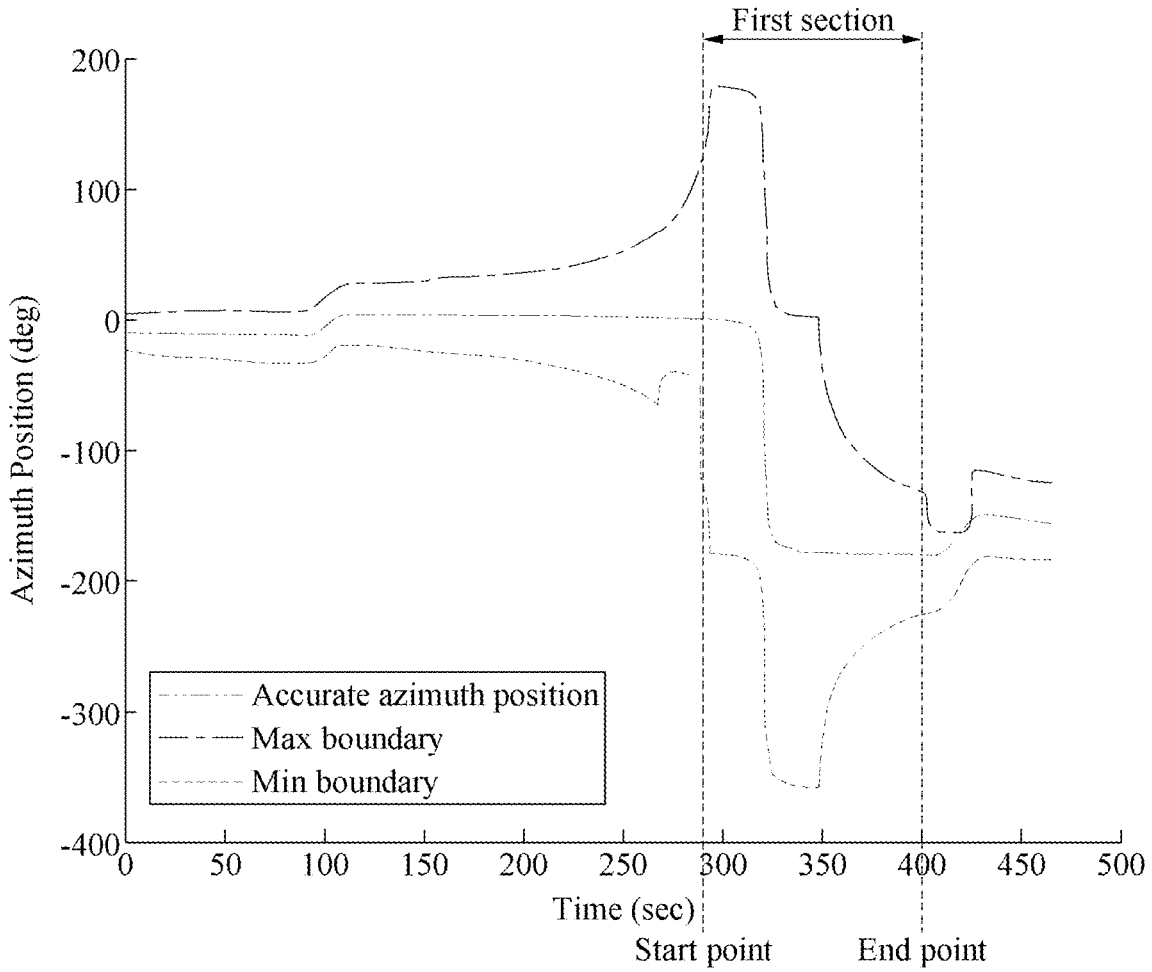
FIG. 14B is an example graph illustrating a modified boundary obtained by applying the velocity optimization through which an angular velocity is set as illustrated in FIG. 14A.

FIG. 14B is an example graph illustrating a modified boundary obtained by applying the velocity optimization through which an angular velocity is set as illustrated in FIG. 14A. In a case that an angular velocity in the section between 290 sec and 400 sec, or the first section, is fixed (or set) to be 1 deg/sec, a lower boundary may need to be modified for a section prior to a start point of the first section, for example, a section between about 260 sec and 290, and an upper boundary may need to be modified for a section subsequent to an end point of the first section, for example, a section between about 400 sec and 430 sec. In FIG. 14B, although a 30 sec section is provided as an example, other suitable values may be selected by an operator in various examples.

To change such sections, the first velocity optimizer may use a method of changing (or modifying as interchangeably used herein) a boundary to form a virtual supporting circle with a radius in the corresponding sections. Here, the radius of the circle and a central position of the circle may be determined based on the fixed angular velocity, for example, 1 deg/sec as illustrated in FIG. 14B.

Figure 14C:
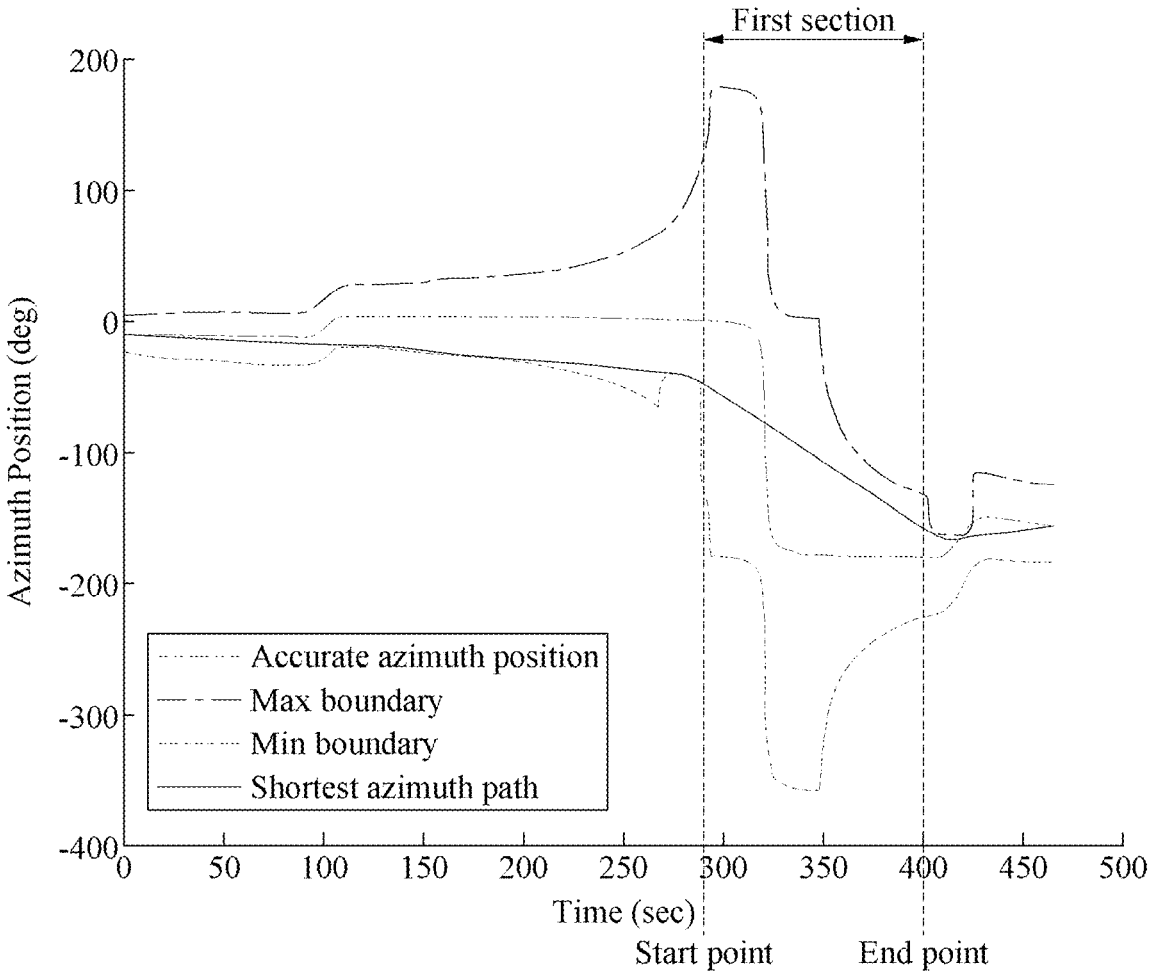
FIG. 14C is an example graph illustrating a minimum azimuth path obtained after the velocity optimization illustrated in FIG. 14B.

FIG. 14C is an example graph illustrating a minimum azimuth path obtained after the velocity optimization illustrated in FIG. 14B. The minimum azimuth path may be generated based on the modified upper boundary and the modified lower boundary.

A second velocity optimizer may be further included to prevent an increase in an angular acceleration in a generated shortest path in a case that a velocity changes rapidly in an upper boundary or a lower boundary of a position range.

Referring back to FIG. 2, the calculator 210 may include the second velocity optimizer (not shown) configured to prevent a rapid change in velocity in a boundary. The second velocity optimizer may calculate an upper boundary including a maximum value of an azimuth position range or an elevation position range, and a lower boundary including a minimum value of the azimuth position range or the elevation position range. The second velocity optimizer may then extract a section in which an angular acceleration of an antenna is greater than a preset first threshold value from the upper boundary, or a section in which the angular acceleration is less than a preset second threshold value from the lower boundary. The upper boundary and the lower boundary may be modified using the first threshold value or the second threshold value with respect to the extracted section.

Figure 15A:
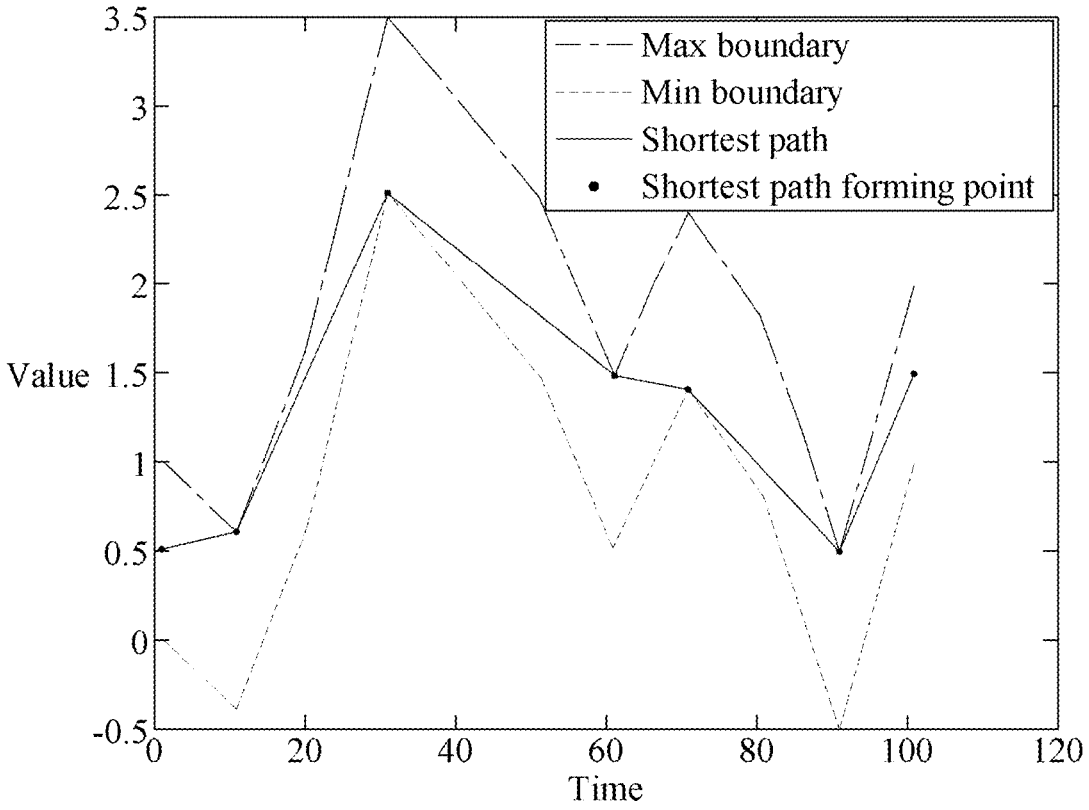
FIG. 15A is an example graph illustrating velocity optimization applied to restrict a maximum angular acceleration in a shortest path according to an example embodiment.
Figure 15B:
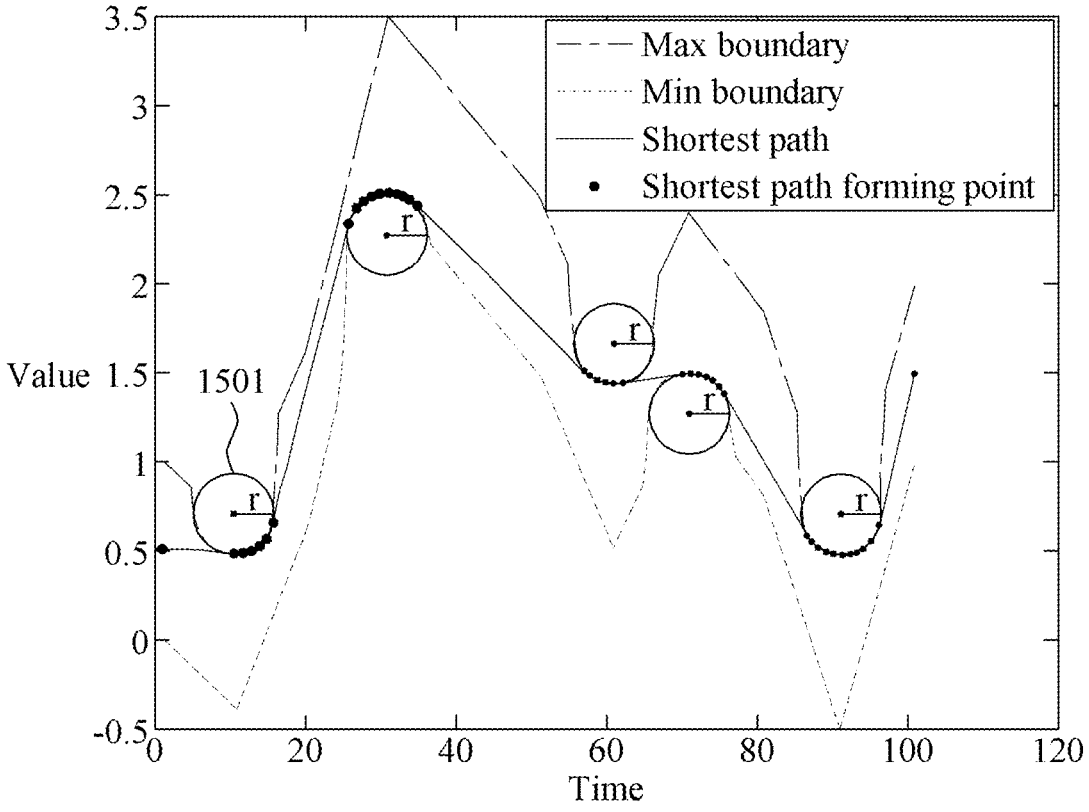
FIG. 15B is an example graph illustrating shortest path forming points at which the maximum angular acceleration is optimized as illustrated in FIG. 15A.
Figure 15C:
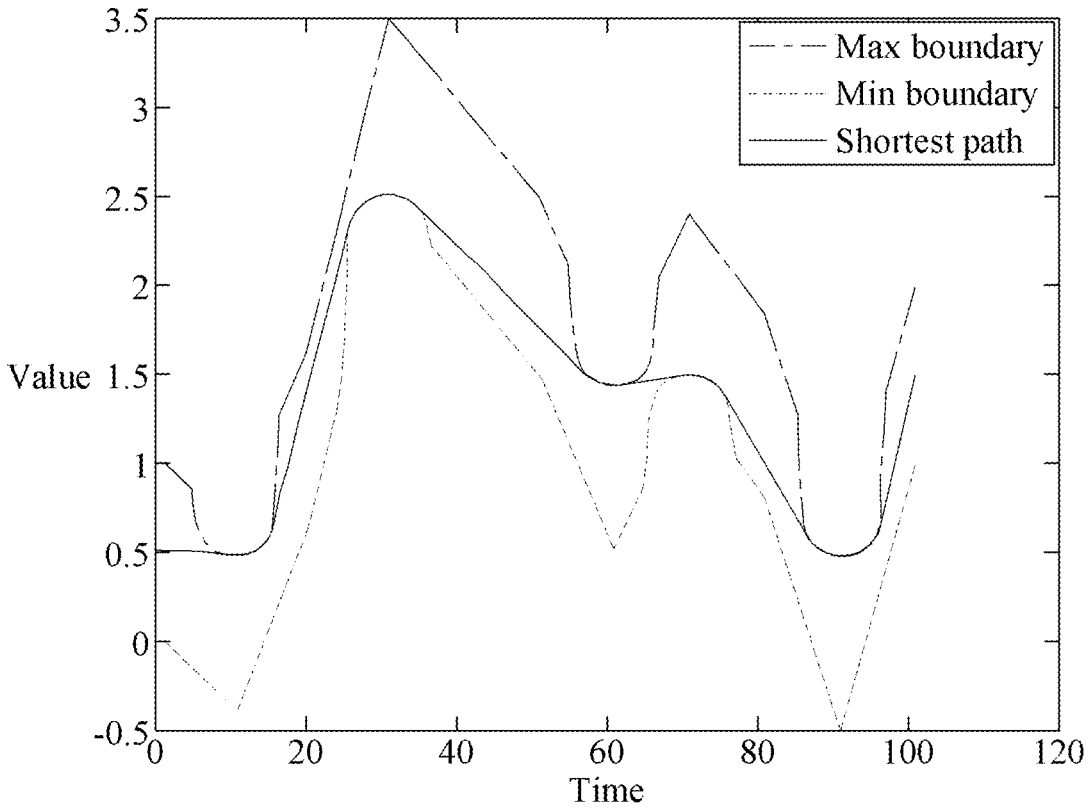
FIG. 15C is an example graph illustrating a shortest path obtained after the velocity optimization illustrated in FIG. 15B.

FIG. 15A is an example graph illustrating velocity optimization applied to restrict a maximum angular acceleration in a shortest path according to an example embodiment. Referring to FIG. 15A, a velocity changes rapidly in a portion of a boundary, for example, a max boundary and a min boundary, illustrated by shortest path forming points. Here, the shortest path forming points refer to all fixed points in the shortest route array described in operation 912 of FIG. 9. A portion in which a change in an angular acceleration in the boundary is large may be modified to be smoother using a virtual supporting circle based on the shortest path forming points as shown in the graph illustrated in FIG. 15A. In detail, a point in an upper boundary (or the max boundary as illustrated) at which an angular acceleration is greater than or equal to a first threshold value, for example, a positive value, may be discovered. In addition, a point in a lower boundary (or the min boundary as illustrated) at which an angular acceleration is less than or equal to a second threshold value, for example, a negative value, may be discovered. Based on the discovered points, for example, the shortest path forming points as illustrated in FIG. 15A, the virtual supporting circle may be used to modify a shape of the upper boundary or the lower boundary to be more circular. FIG. 15B is an example graph illustrating shortest path forming points at which the maximum angular acceleration is optimized as illustrated in FIG. 15A. Referring to FIG. 15B, a virtual circle 1501 with a radius r may be used to modify the discovered points. Here, the radius r of the virtual circle 1501 may be determined using an angular acceleration value that is allowable based on an antenna. FIG. 15C is an example graph illustrating a shortest path obtained after the velocity optimization illustrated in FIG. 15B. Referring to FIG. 15C, a shortest path may be generated using a smoother boundary that is obtained by modifying an edge-shaped boundary using a circle by the second velocity optimizer according to an example embodiment.

The units described herein may be implemented using hardware components and software components. For example, the hardware components may include microphones, amplifiers, band-pass filters, audio to digital convertors, non-transitory computer memory and processing devices. A processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums. The non-transitory computer readable recording medium may include any data storage device that can store data which can be thereafter read by a computer system or processing device.

The above-described embodiments of the present disclosure may be recorded in non-transitory computer-readable media including program instructions to implement various operations embodied by a computer. The media may also include, alone or in combination with the program instructions, data files, data structures, and the like. Examples of non-transitory computer-readable media include magnetic media such as hard disks, floppy disks, and magnetic tapes; optical media such as CD ROMs and DVDs; magneto-optical media such as floptical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments of the present disclosure, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An apparatus for controlling a driving speed of movement of an antenna of a mobile satellite travelling in an orbit, the apparatus comprising:

at least one processor, when executing stored instructions, caused to:

calculate an azimuth position range between a first point and a second point in the orbit, the azimuth position range defining a boundary of effective azimuth positions of the antenna at each of a plurality of orbit points between the first and second points of the orbit that allow a ground station to receive one or more signals transmitted from the satellite without jitter-related data loss;

calculate an elevation position range between the first point and the second point in the orbit, the elevation position range defining a boundary of effective elevation positions of the antenna at each of the plurality of orbit points between the first and second points of the orbit that allow the ground station to receive the one or more signals transmitted from the satellite without the jitter-related data loss;

generate a path profile of the antenna based on the calculated azimuth position range and the elevation position range, the path profile defining a plurality of possible position paths of the antenna in the path profile, each possible position path defining a set of effective azimuth positions and the effective elevation positions for orienting the antenna as the satellite travels from the first point to the second point of the orbit;

select a position path from the plurality of possible position paths defined in the path profile; and control, via a driver, the driving speed of movement of the antenna by mechanically orienting the antenna in accordance with the set of effective azimuth positions and effective elevation positions of the selected position path as the satellite travels from the first point to the second point of the orbit.

2. The apparatus of claim 1, wherein the selected position path is a shortest path of the plurality of possible position paths defined in the path profile, the shortest path having a least total positional change among the set of effective azimuth positions and the effective elevation positions from the first point to the second point of the orbit.

3. The apparatus of claim 2, wherein the at least one processor is further caused to determine the shortest path by using: an upper boundary of the boundaries of the effective azimuth positions or the effective elevation positions including a maximum value in the azimuth position range or the elevation position range, a lower boundary of the boundaries of the effective azimuth positions or the effective elevation positions including a minimum value in the azimuth position range or the elevation position range, a start point of the orbit being the first point, and an end point of the orbit being the second point.

4. The apparatus of claim 3, wherein the determination of the shortest path comprises the at least one processor further caused to:

add the start point and the end point as new fixed points to a shortest route array, the shortest route array including at least one fixed point indicating a value of a position in the orbit based on a time for generating the shortest route, and in response to presence of an intersection point between a straight line passing all two successive fixed points in a time order included in the shortest route array and the upper boundary or the lower boundary, update the shortest route array by adding, to the shortest route array as a new fixed point, a point on the upper boundary or the lower boundary separated farthest from the straight line in a time section classified by the intersection point.

5. The apparatus of claim 3, wherein the at least one processor is further caused to determine the shortest path using a shortest path algorithm.

6. The apparatus of claim 1, wherein the at least one processor is further caused to:

calculate an upper boundary of the boundaries of the effective azimuth positions or the effective elevation positions including a maximum value in the azimuth position range or the elevation position range, and a lower boundary of the boundaries of the effective azimuth positions or the effective elevation positions including a minimum value in the azimuth position range or the elevation position range;

determine a time period associated with a first time section for maintaining a fixed angular velocity within the upper boundary or the lower boundary; and obtain the fixed angular velocity by adjusting the upper boundary or the lower boundary corresponding to the first time section based on a velocity limit.

7. The apparatus of claim 1, wherein the at least one processor is further caused to:

calculate an upper boundary of the boundaries of the effective azimuth positions or the effective elevation positions including a maximum value in the azimuth position range or the elevation position range, and a lower boundary of the boundaries of the effective azimuth positions or the effective elevation positions including a minimum value in the azimuth position range or the elevation position range;

determine, from the upper boundary, a first time period associated with a first time section in which an angular acceleration of the antenna is greater than a first threshold value, or determine, from the lower boundary, a second time period associated with a second time section in which the angular acceleration of the antenna is less than a second threshold value, and adjust at least one portion of the upper boundary or the lower boundary using the first threshold value or the second threshold value.

8. The apparatus of claim 1, wherein the mobile satellite comprises a biaxial gimbal-type antenna.

9. A mobile satellite comprising:

a driver for mechanically orienting an antenna of the mobile satellite; and at least one processor, when executing stored instructions, caused to:

calculate an azimuth position range between a first point and a second point in an orbit, the azimuth position range defining a boundary of effective azimuth positions of the antenna at each of a plurality of orbit points between the first and second points of the orbit that allow a ground station to receive one or more signals transmitted from the satellite without jitter-related data loss;

calculate an elevation position range between the first point and the second point in the orbit, the elevation position range defining a boundary of effective elevation positions of the antenna at each of the plurality of orbit points between the first and second points of the orbit that allow the ground station to receive the one or more signals transmitted from the satellite without the jitter-related data loss;

generate a path profile of the antenna based on the calculated azimuth position range and the elevation position range, the path profile defining a plurality of possible position paths of the antenna in the path profile, each possible position path defining a set of effective azimuth positions and the effective elevation positions for orienting the antenna as the satellite travels from the first point to the second point of the orbit;

select a position path from the plurality of possible position paths defined in the path profile; and control, via the driver, a driving speed of a movement of the antenna by mechanically orienting the antenna in accordance with the set of effective azimuth positions and effective elevation positions of the selected position path as the satellite travels from the first point to the second point of the orbit.

10. The mobile satellite of claim 9, wherein the selected position path is a shortest path of the plurality of possible position paths defined in the path profile, the shortest path having a least total positional change among the set of effective azimuth positions and the effective elevation positions from the first point to the second point of the orbit.

11. The mobile satellite of claim 10, wherein the at least one processor is further caused to determine the shortest path by using:

an upper boundary of the boundaries of the effective azimuth positions or the effective elevation positions including a maximum value in the azimuth position range or the elevation position range, a lower boundary of the boundaries of the effective azimuth positions or the effective elevation positions including a minimum value in the azimuth position range or the elevation position range, a start point of the orbit being the second point; and an end point of the orbit being the second point.

12. The mobile satellite of claim 11, wherein the determination of the shortest path comprises the at least one processor further caused to:

add the start point and the end point as a new fixed point to a shortest route array, the shortest route array including at least one fixed point indicating a value of a position in the orbit based on a time for generating the shortest route, and in response to presence of an intersection point between a straight line passing all two successive fixed points in a time order included in the shortest route array and the upper boundary or the lower boundary, update the shortest route array by adding, to the shortest route array as a new fixed point, a point on the upper boundary or the lower boundary separated farthest from the straight line in a time section classified by the intersection point.

13. A computer program embodied on a non-transitory computer readable medium, the computer program being configured to cause at least one processor to control a speed of movement of an antenna of a mobile satellite, the program comprising:

calculate an azimuth position range between a first point and a second point in an orbit, the azimuth position range defining a boundary of effective azimuth positions of the antenna at each of a plurality of orbit points between the first and second points of the orbit that allow a ground station to receive one or more signals transmitted from the satellite without jitter-related data loss;

calculate an elevation position range between the first point and the second point in the orbit, the elevation position range defining a boundary of effective elevation positions of the antenna at each of the plurality of orbit points between the first and second points of the orbit that allow the ground station to receive the one or more signals transmitted from the satellite without the jitter-related data loss;

generate a path profile of the antenna based on the calculated azimuth position range and the elevation position range, the path profile defining a plurality of possible position paths of the antenna in the path profile, each possible position path defining a set of effective azimuth positions and the effective elevation positions for orienting the antenna as the satellite travels from the first point to the second point of the orbit;

select a position path from the plurality of possible position paths defined in the path profile; and control, via a driver, the speed of movement of the antenna by mechanically orienting the antenna in accordance with the set of effective azimuth positions and effective elevation positions of the selected position path as the satellite travels from the first point to the second point of the orbit.

* * * * *